US009469501B2

(12) United States Patent
Lee

(10) Patent No.: US 9,469,501 B2
(45) Date of Patent: Oct. 18, 2016

(54) ELEVATOR POSITIONING CLIP SYSTEM AND METHOD

(71) Applicant: ThyssenKrupp Elevator Corporation, Atlanta, GA (US)

(72) Inventor: Sang W. Lee, Germantown, TN (US)

(73) Assignee: ThyssenKrupp Elevator Corporation, Atlanta, GA (US)

( * ) Notice: Subject to any disclaimer, the term of this patent is extended or adjusted under 35 U.S.C. 154(b) by 471 days.

(21) Appl. No.: 14/046,937

(22) Filed: Oct. 5, 2013

(65) Prior Publication Data

US 2015/0096844 A1 Apr. 9, 2015

(51) Int. Cl.
*B66B 1/34* (2006.01)
*B66B 1/36* (2006.01)

(52) U.S. Cl.
CPC ..... *B66B 1/36* (2013.01); *B66B 1/3492* (2013.01)

(58) Field of Classification Search
CPC ..... B66B 1/36; B66B 1/3492
USPC ..... 187/247, 277, 281–284, 391, 393, 394, 187/414, 900
See application file for complete search history.

(56) References Cited

U.S. PATENT DOCUMENTS 1,920,590 A * 8/1933 Pedersen ..... B66B 1/50 187/284
4,433,756 A 2/1984 Caputo et al.
4,750,592 A * 6/1988 Watt ..... B66B 1/3492 187/394
4,798,267 A 1/1989 Foster et al.
5,135,081 A * 8/1992 Watt ..... B66B 1/3492 187/394
5,677,519 A 10/1997 Herkel et al.
5,798,490 A * 8/1998 Vairio ..... B66B 1/50 187/283
5,889,239 A * 3/1999 Blackaby ..... B66B 1/40 187/391
5,893,433 A * 4/1999 Koura ..... B66B 1/50 187/282

(Continued)

FOREIGN PATENT DOCUMENTS

DE 10 2009 054 337 6/2011
JP 02048389 A * 2/1990

OTHER PUBLICATIONS

US Office Action, Non-Final, dated Sep. 9, 2015 for U.S. Appl. No. 13/802,368.

(Continued)

*Primary Examiner* — Anthony Salata
(74) *Attorney, Agent, or Firm* — Frost Brown Todd LLC

(57) ABSTRACT

An elevator positioning system includes an optical tape, optical tape clips, and a sensor. The optical tape clips are mountable to various structures within the hoistway. A crossbar of the optical tape clips is located between a sensor and optical tape such that the sensor detects an interruption in the optical tape and signals the detection to an elevator controller. The elevator car can then be controlled to align evenly with the landings associated with the hoistway. Another elevator positioning system includes a sensor and a reflector clip assembly. The reflector clip assemblies are mountable to various structures within the hoistway. A reflector target of the reflector clip assemblies faces the sensor such that the sensor detects the reflector target and signals the detection to an elevator controller. The elevator car can then be controlled to align evenly with the landings associated with the hoistway.

23 Claims, 22 Drawing Sheets

(56) References Cited

U.S. PATENT DOCUMENTS

| | | | | |
|---|---|---|---|---|
| 5,925,859 | A | 7/1999 | Miller et al. | |
| 6,128,116 | A | 10/2000 | Dobler et al. | |
| 6,276,493 | B1 * | 8/2001 | Lacarte Estallo | B66B 7/027 187/391 |
| 6,283,253 | B1 * | 9/2001 | Folli | B66B 1/50 187/391 |
| 6,435,315 | B1 | 8/2002 | Zaharia | |
| 6,612,403 | B2 * | 9/2003 | Silberhorn | B66B 1/3492 187/394 |
| 6,622,827 | B1 | 9/2003 | Disieno | |
| 6,886,667 | B2 | 5/2005 | Kunz et al. | |
| 6,945,296 | B2 | 9/2005 | Kunz | |
| 6,986,409 | B2 | 1/2006 | Birbaumer | |
| 7,562,747 | B2 * | 7/2009 | Marchesi | B66B 1/3492 187/291 |
| 7,571,791 | B2 | 8/2009 | Finn et al. | |
| 7,597,176 | B2 | 10/2009 | Zaharia | |
| 7,600,613 | B2 | 10/2009 | Kang et al. | |
| 7,669,696 | B2 | 3/2010 | Osmanbasic | |
| 8,985,281 | B2 | 3/2015 | De Coi et al. | |
| 2003/0070883 | A1 | 4/2003 | Foster et al. | |
| 2004/0129503 | A1 * | 7/2004 | Kunz | B66B 1/3492 187/391 |
| 2013/0284544 | A1 | 10/2013 | De Coi et al. | |
| 2015/0060213 | A1 * | 3/2015 | De Coi | B66B 1/3492 187/394 |
| 2015/0102097 | A1 | 4/2015 | Schatt et al. | |

OTHER PUBLICATIONS

US Office Action, Notice of Allowance, dated Jan. 26, 2016 for U.S. Appl. No. 13/802,368.

International Search Report and Written Opinion dated Jan. 20, 2015 for Application No. PCT/US2014/056507.

* cited by examiner

ELEVATOR POSITIONING CLIP SYSTEM AND METHOD

BACKGROUND

In the field of elevators, it is desirable to properly position elevator cars at landings in a building to aid with the entry, exit, and safety of elevator car passengers. While there may be devices and method that attempt to accomplish this, it is believed that no one prior to the inventor(s) has made or used an invention as described herein.

BRIEF DESCRIPTION OF THE DRAWINGS

It is believed the present invention will be better understood from the following description of certain examples taken in conjunction with the accompanying drawings, in which like reference numerals identify the same elements.

Figure 1:
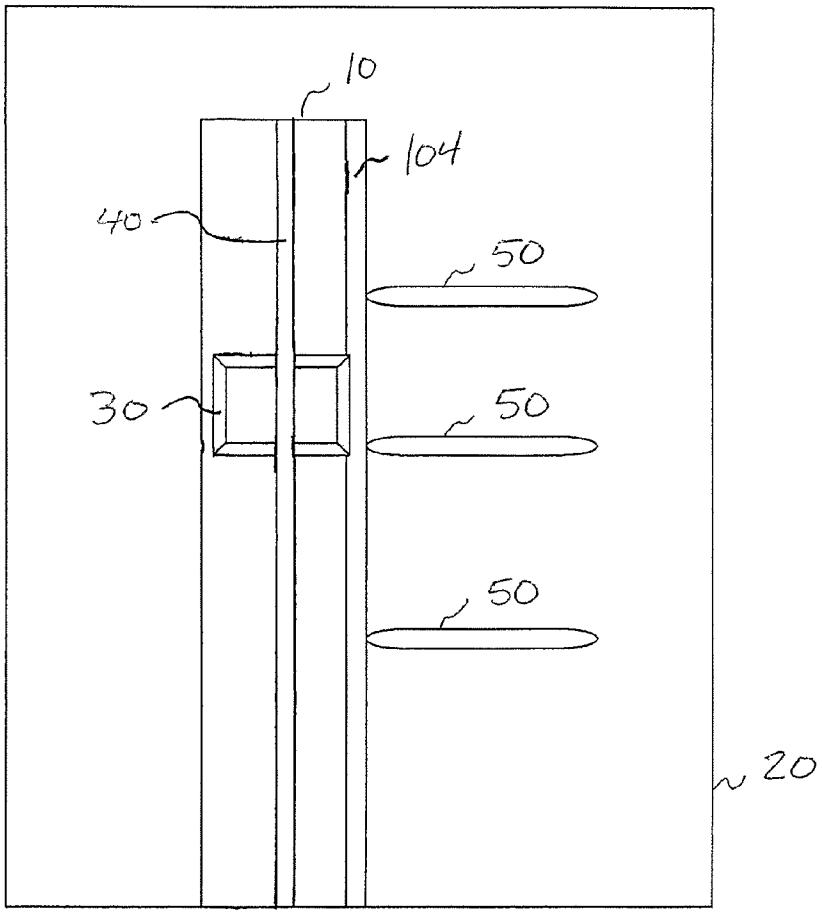
FIG. 1 depicts an elevation view of an exemplary building including a hoistway with an elevator car configured to travel along rails in the hoistway to various landings.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description. As will be realized, the invention is capable of other different and obvious aspects, all without departing from the invention. Accordingly, the drawings and descriptions should be regarded as illustrative in nature and not restrictive.

This application is related to U.S. Nonprovisional patent application Ser. No. 13/802,368, filed Mar. 13, 2013, entitled Elevator Positioning System and Method, the disclosure of which is incorporated by reference herein.

FIG. 1 illustrates an exemplary hoistway (10) in and exemplary building (20). An exemplary elevator car (30) travels along exemplary guide rails (40) in hoistway (10) to transport passengers between various exemplary landings (50) in a manner as will be apparent to one of ordinary skill in the art in view of the teachings herein. Described below are exemplary elevator car positioning systems and methods for use with the exemplary elevator arrangement shown in FIG. 1 as well as other elevator arrangements that will be apparent to those of ordinary skill in the art in view of the teachings herein.

Exemplary Elevator Positioning System Using Optical Tape

Figure 2:
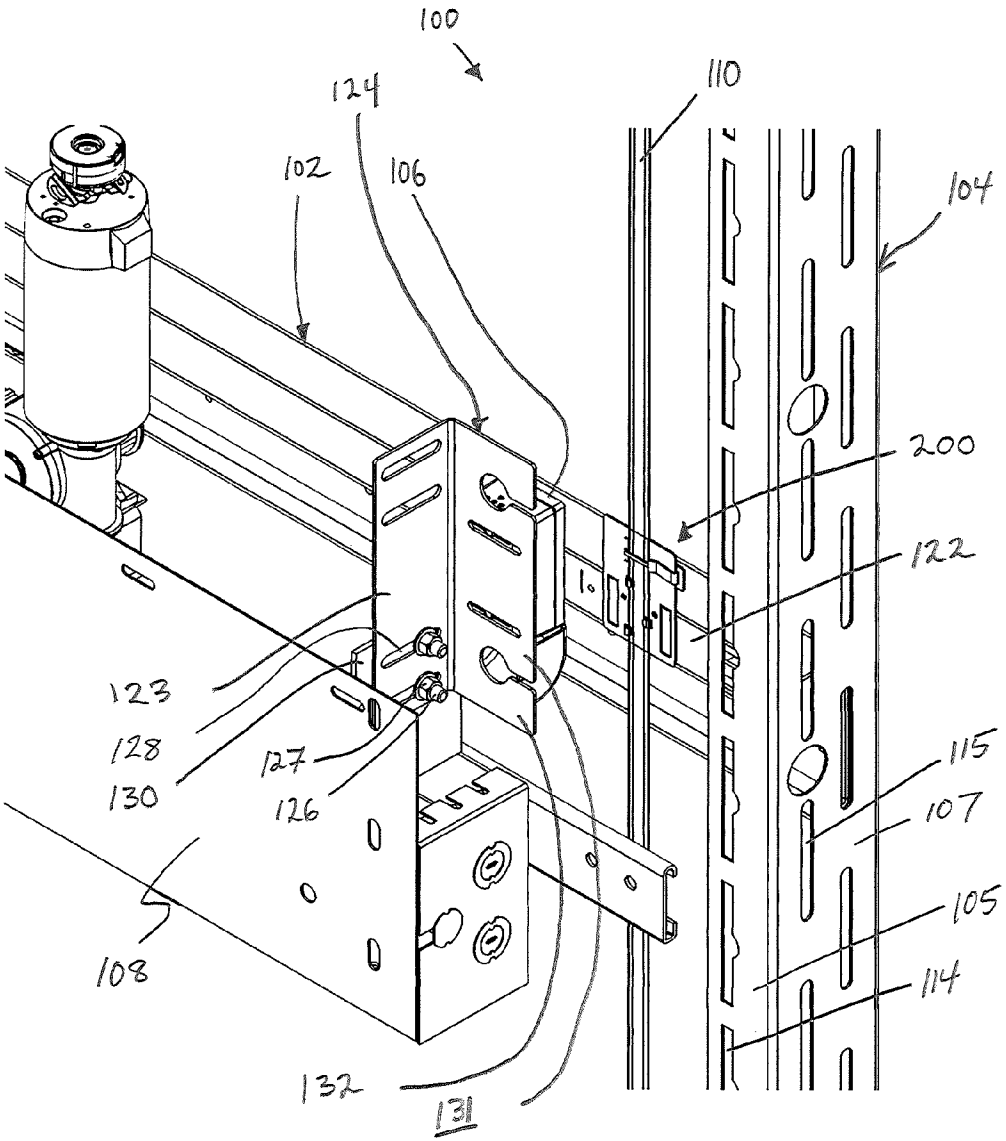
FIG. 2 depicts a partial perspective view of an exemplary hoistway showing an exemplary optical tape clip and other components installed within a hoistway.

FIG. 2 illustrates an exemplary elevator positioning system (100) that comprises hoistway header (102), entrance struts (104), sensor (106), elevator door operator assembly (108), optical tape (110), and optical tape clips (200). Hoistway header (102) is a component of a hoistway frame that is connected to hoistway (10). In the present example, hoistway header (102) is disposed near the top of an entryway to one of landings (50). As will be understood by those of ordinary skill in the art in view of the teachings herein, the entryway comprises an opening that can be substantially similarly sized to the opening defined by the one or more doors of elevator car (30).

Figure 3:
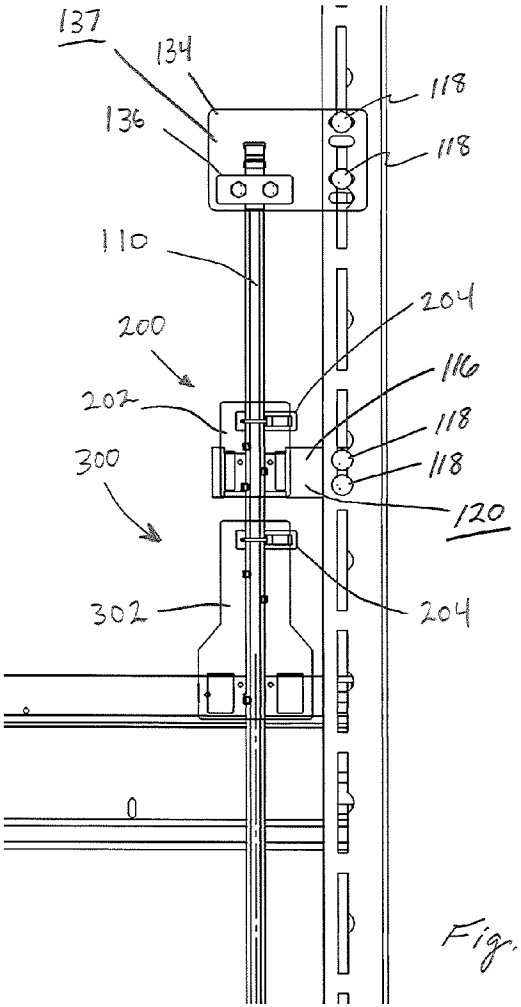
FIG. 3 depicts a side view of a top portion of the hoistway of FIG. 2.

Hoistway header (102) includes bent portion (122) that, in the present example but not required in all examples, extends along the length of hoistway header (102). Struts (104) comprise first strut portion (105) including slots (114) and second strut portion (107) positioned, in the illustrated version, generally perpendicular to first strut portion (105) with second strut portion (107) including slots (115). As shown in FIG. 3, optional mounting brackets (116) are configured for selective attachment with struts (104). Mounting brackets (116) include connectors (118) that are sized and shaped to be received through an enlarged portion of slots (114) and are slidable along slots (114) to securely positioned mounting bracket (116) to strut (104). When secured to struts (104), mounting brackets (116) transversely project from struts (104) such that a first surface (120) of mounting bracket (116) faces elevator car (30). Mounting brackets (116) are optional features that provide a location for attaching an optical tape clip (200) for elevators with reverse entrances.

Elevator car (30) includes elevator door operator assembly (108) to which sensor (106) is attached in the present example. Elevator door operator assembly (108) is generally located above and directly or indirectly connected with the elevator doors so as to open and close the doors in operation. In view of the teachings herein, those of ordinary skill in the art will understand suitable configurations for and operability of elevator door operator assembly (108).

In the present example, sensor (106) is an optical sensor such as an absolute positioning sensor or other suitable sensor as will be apparent to one of ordinary skill in the art in view of the teachings herein. Sensor (106) is configured to detect the presence of optical tape (110). By way of example only, and not limitation, in some versions sensor (106) is spaced about 4 inches from optical tape (110). In such a configuration, sensor (106) measures a central area of optical tape (110). In some versions sensor (106) has a field of view of plus or minus 0.375 inches from a centerline of optical tape (110). In the present example, sensor (106) connects with elevator door operator assembly (108) via bracket (124). A first portion (123) of bracket (124) is configured to attach to a portion (130) of elevator door operator assembly (108) via fastener components such as bolts, screws, etc. In the present example, first portion (123) of bracket (124) comprises slots (128) and threaded bolts (126) extend through slots (128) and through corresponding slots (not shown) in portion (130) of elevator door operator assembly (108). Corresponding threaded nuts (127) engage with threaded bolts (126) to securely connect bracket (124) with elevator door operator assembly (108). A second portion (132) of bracket (124) transversely projects from first portion (123) such that a first surface (131) of second portion (132) faces elevator door operator assembly (108) and an opposing second surface faces landings (50). A rear portion of sensor (106) is configured to attach to the second surface of second portion (132) of bracket (124) such that a front, detecting portion of sensor (106) faces toward optical tape (110) as shown in FIG. 2.

Optical tape (110) is made from a durable and dimensionally stable material that is suitable for detection by sensor (106). In some versions optical tape (110) is constructed of a plastic film attached to a retroreflective background adhered to a metal band. Other suitable materials, construction, and configuration for optical tape (110) will be apparent to those of ordinary skill in the art in view of the teachings herein. In the present example optical tape (110) comprises a central region and outer regions on each side of the central region. Sensor (106) is generally calibrated to detect the central region of optical tape (110), which may have a different color, pattern, or material than outer regions. Optical tape (110) generally extends continuously at least the length of the travel distance of elevator car (30), although such continuously extension is not required in all versions. In some contexts, optical tape (110) is considered a type of detectable member, for instance, where sensor (106) is configured to detect optical tape (110). In some versions there may be other detectable members instead of or in addition to optical tape (110).

Figure 4:
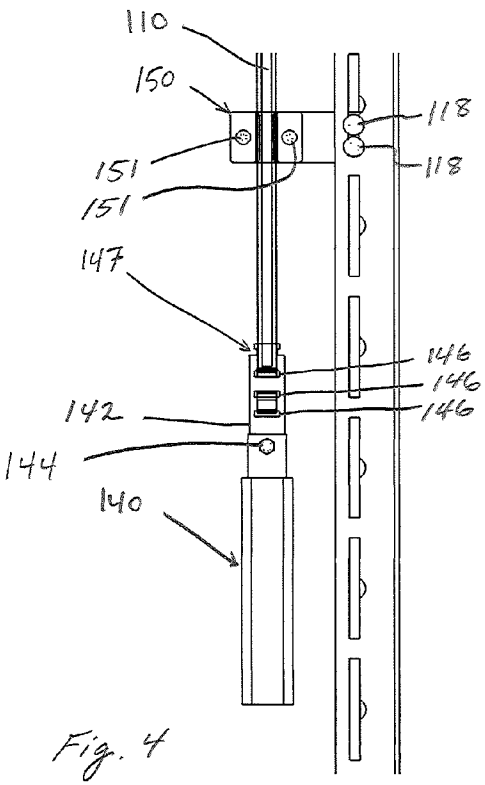
FIG. 4 depicts a side view of a bottom portion of the hoistway of FIG. 2.

FIGS. 3 and 4 illustrate how optical tape (110) is mounted near top and bottom portions of hoistway (10). FIG. 3 shows a top or upper portion of hoistway (10) including top mounting bracket (134) that includes connectors (118) sized and shaped to be securely positioned within slots (114) in the same or similar manner described above with respect to mounting bracket (116). In the present example, top mounting bracket (134) includes a pair of apertures and clamp (136) to receive and retain optical tape (110). In one example, optical tape (110) is threaded through the apertures forming a loop near the upper part of optical tape (110). In such a configuration, the free end of optical tape (110) first passes through a bottom aperture of top mounting bracket (134) from a first surface (137) of top mounting bracket (134), then passes through top aperture of top mounting bracket (134) from a second surface (not shown) of top mounting bracket (134), then extends downward to a position adjacent the remainder of optical tape (110) contacting top mounting bracket (134). Optical tape (110) is then secured with clamp (136), which compresses optical tape (110) between clamp (136) and first surface (137) of top mounting bracket (134). Clamp (136) connects with top mounting bracket (134) via a bolted connection (138) in the present example, however other ways to connect clamp (136) to top mounting bracket (134) will be apparent to those of ordinary skill in the art in view of the teaching herein.

FIG. 4 shows a bottom or lower portion of hoistway (10) including weight (140) that is fastened to a bottom mounting plate (142) though means such as fastener (144), which may be a screw or other fastener as will be apparent to one of ordinary skill in the art in view of the teachings herein. Weight (140) may weigh, for example, 4.54 kg or another suitable weight as will be apparent to one of ordinary skill in the art in view of the teachings herein. Bottom mounting plate (142) includes three apertures (146) and narrow portion (147). Bottom mounting plate (142), in one example, is configured to receive optical tape (110) in a weaving manner via apertures (146) before optical tape (110) is secured by a cable tie around optical tape (110) at narrow portion (147). In some versions, optional bracket (150) is configured to receive optical tape (110) and is configured to be disposed substantially near and above bottom mounting plate (142). Bracket (150) is fastened to strut (104) through fasteners (118) in a manner as will be apparent to one of ordinary skill in the art in view of the teachings herein. Bracket (150) comprises guides (151) that protrude at least slightly from bracket (150) and are configured to stabilize optical tape (110) above bottom mounting plate (142) and weight (140) from undesired swaying motion. In view of the teachings herein, other ways to mount optical tape (110) within hoistway (10) will be apparent to those of ordinary skill in the art.

FIGS. 5-13 illustrate exemplary optical tape clip (200). In at least some versions, optical tape clips (200) are considered a type of positioning member as they aid in positioning elevator car (30). Optical tape clip (200) comprises primary clip (202) and secondary clip (204). Primary clip (202) comprises plate (206), arms (208), guides (210), and alignment targets (212). Plate (206) has a mostly flat surface and can be constructed of a metal such as stainless steel. Of course plate (206) can be constructed of other materials such as plastic, aluminum, and other materials that will be apparent to those of ordinary skill in the art in view of the teachings herein. In the present example, plate (206) has dimensions of about 2.75 inches wide (as shown in the X direction in FIG. 6) by 3.75 inches high (as shown in the Y direction in FIG. 6). Plate (206) optionally includes holes (216) that can be used in some version with fasteners to attach plate (206) to another structure, although use of holes (216) and fasteners in this manner is not required.

Arms (208) represent resilient grasping members that are used to attach optical tape clips (200) to other structures. For instance, in the present example, arms (208) are configured to grasp a portion of hoistway header (102), more specifically bent portion (122) of hoistway header (102). Each arm (208) includes curved portion (218) and first and second angled portions (220, 222) that are resiliently biased such that second angled portion (220) wants to return to or maintain a position generally adjacent plate (206). With the resilient nature of arms (208), optical tape clip (200) is attachable to a mounting feature, e.g., hoistway header (102) and/or mounting bracket (116). In the present example and other versions, optical tape clips (200) can be installed on hoistway headers (102) and/or mounting brackets (116) without the use of tools. In the present example, arms (208) comprise punched sections formed from plate (206). These punched sections are bent to the shape shown in the illustrated version and described above. In some other versions, arms (208) could be made as separate pieces from plate (206) and then attached to plate (206) by welding or other fastening means. As used throughout, when describing a part as punched or punched and bent, it should be understood that other descriptions and terms may equally apply. For instance, arms (208) can be considered a stamped out section of plate (206) or a cut-out section of plate (206). In either or both of these cases, the stamped out or cut-out section is bent to be formed into arms (208).

Figure 7:
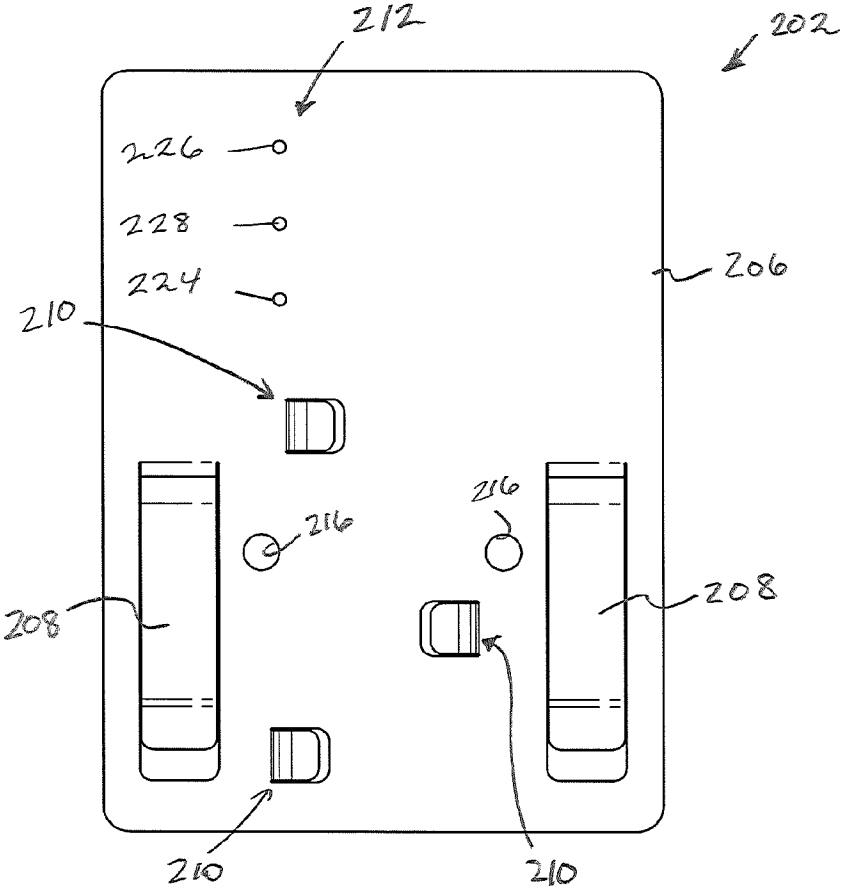
FIG. 7 depicts a front view of the primary clip of the optical tape clip of FIG. 5.
Figure 9:
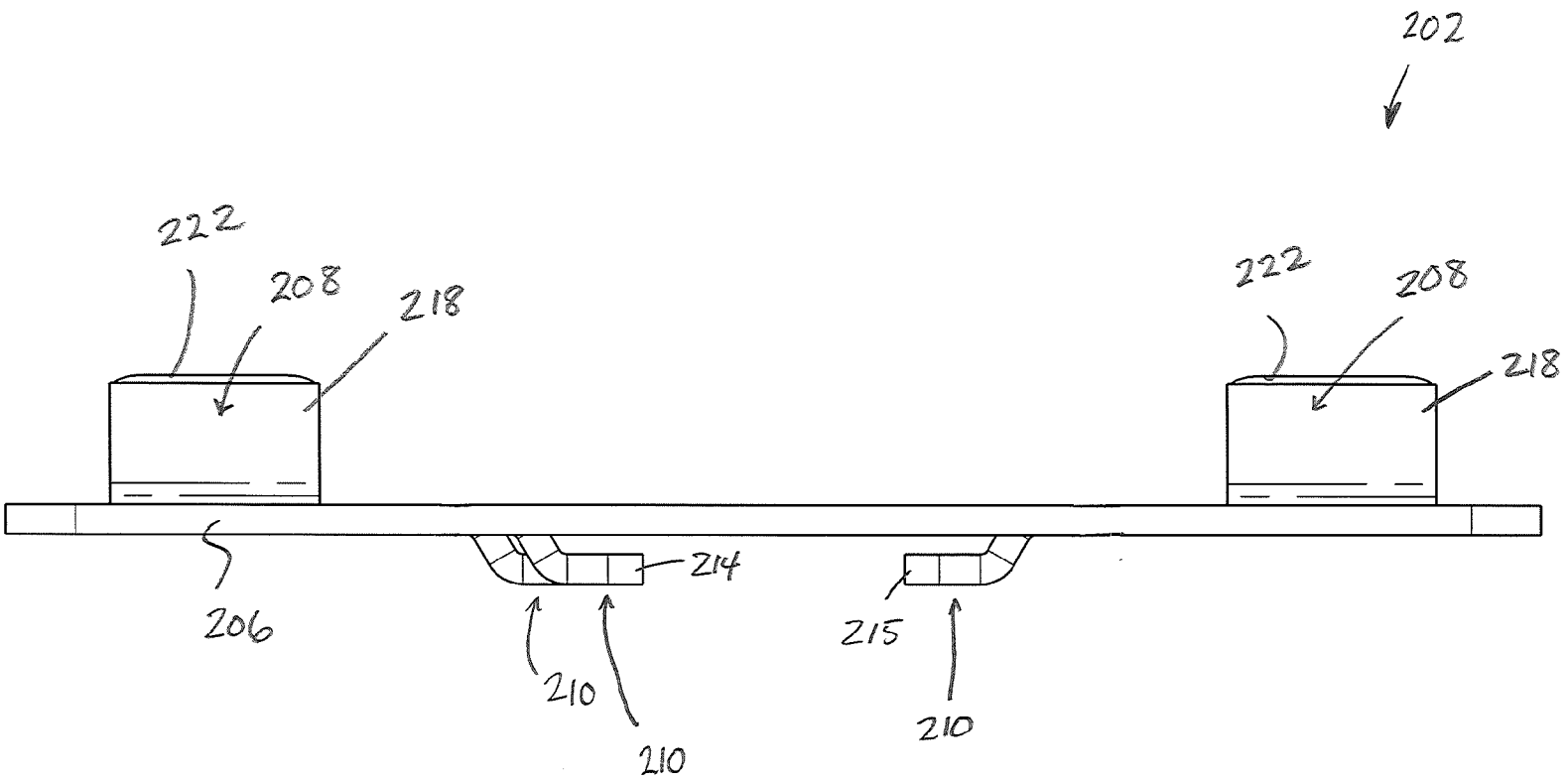
FIG. 9 depicts a top view of the primary clip of the optical tape clip of FIG. 5.
Figure 10:
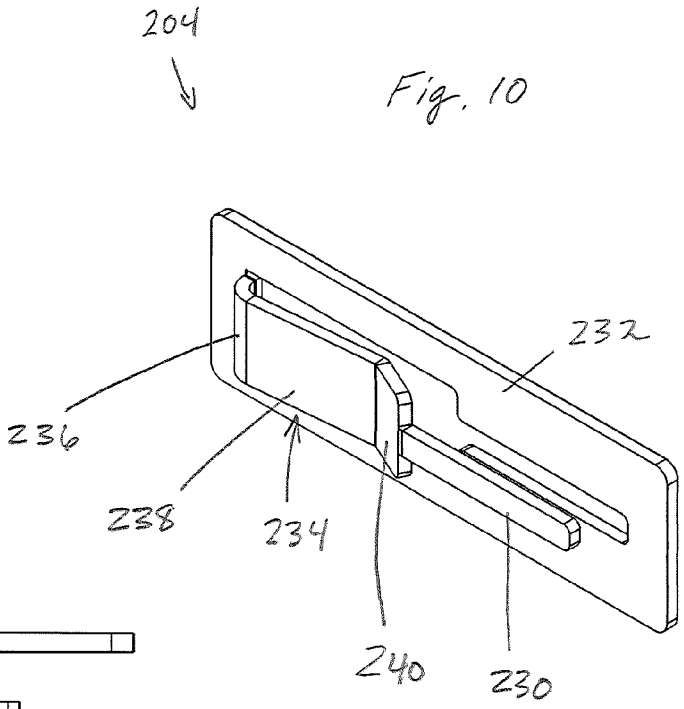
FIG. 10 depicts a perspective view of the secondary clip of the optical tape clip of FIG. 5.

Guides (210) define lateral boundaries within which optical tape (110) can be positioned without its vertical movement being restricted. In the present example, guides (210) comprise punched and bent tabs formed from plate (206). In some versions there are three such guides (210), but there may be more or fewer guides (210) in other versions. The guides (210) in the illustrated version appear as hooks where two of the hooks have their ends (214) facing the end (215) of the opposite facing hook. Guides (210) assist to prevent optical tape (110), when extending along optical tape clip (200), from substantially deviating in a lateral or horizontal direction as guides (210) provide a stopping structure for optical tape (110) to abut against. In this sense guides (210) can also be considered or referred to as retainers or retainer clips. As seen best from FIGS. 7 and 9, in the illustrated version guides (210) are staggered vertically by alternating their placement from the left side of plate (206) to the right side of plate (206) when looking at a front view of plate (206) as shown in FIG. 7. Also in the illustrated version as best seen in FIG. 9, the two left-most guides (210) are positioned such that the lower-most guide (210) is slightly further toward the left side of plate (206) compared to the upper-most guide (210). In the present version, guides (210) define a gap between guides (210) and plate (206) of about 0.035 inches. In this way optical tape (110) is not firmly held against plate (206) and thus optical tape (110) is free to move vertically.

Figure 5:
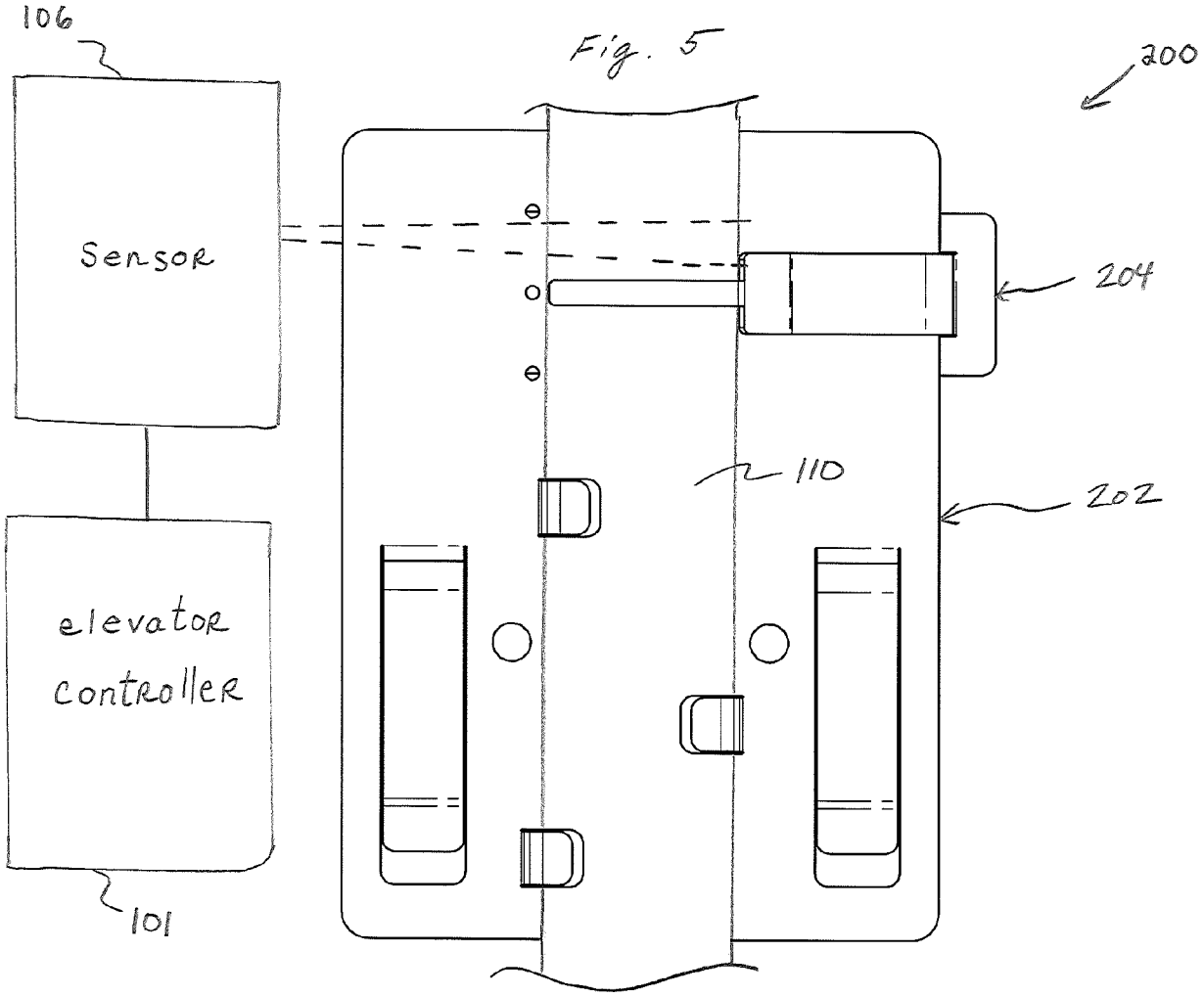
FIG. 5 depicts a front view of an exemplary optical tape clip as shown in FIG. 2, with a sensor and elevator controller shown schematically.
Figure 6:
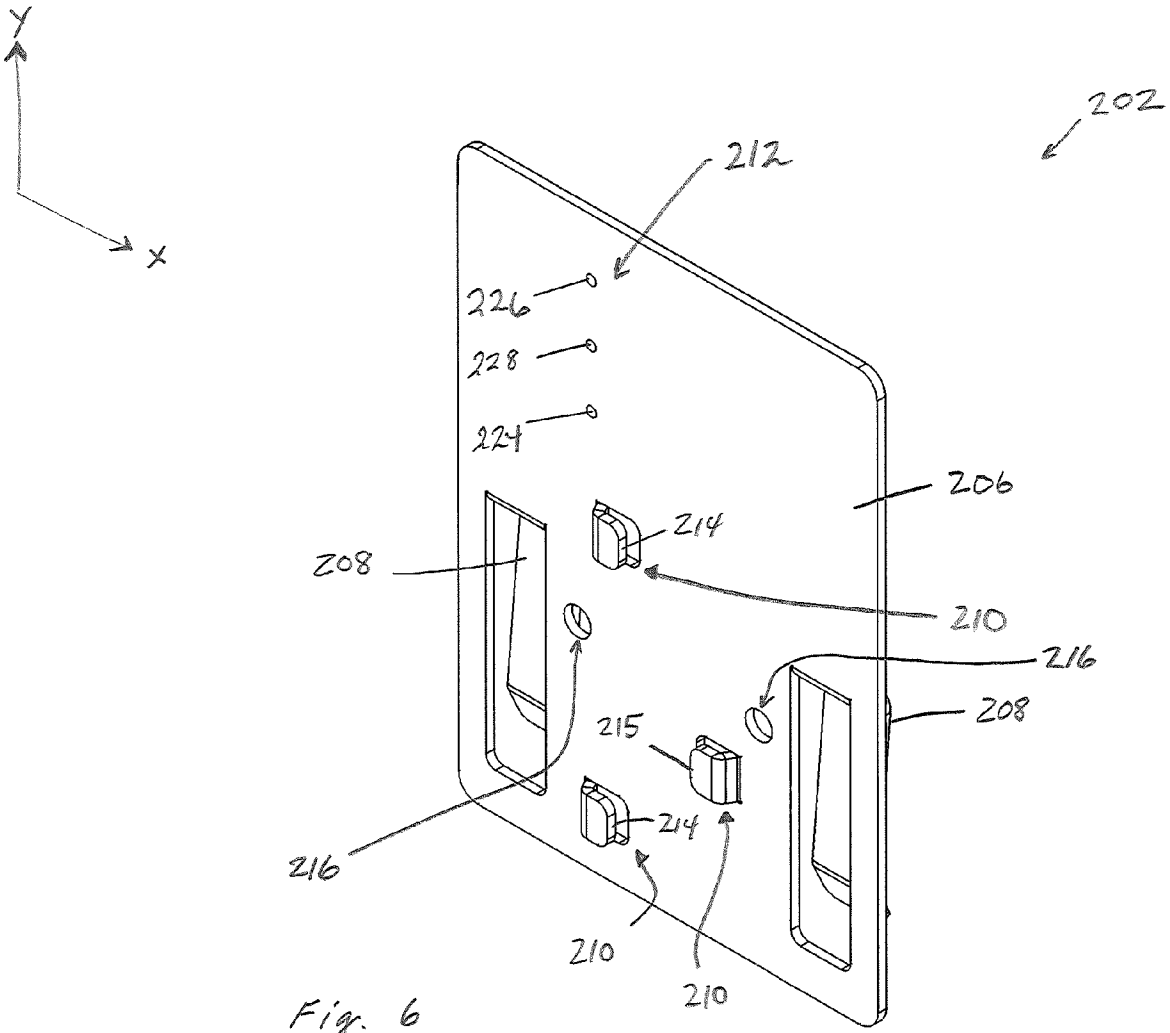
FIG. 6 depicts a perspective view of the primary clip of the optical tape clip of FIG. 5.
Figure 8:
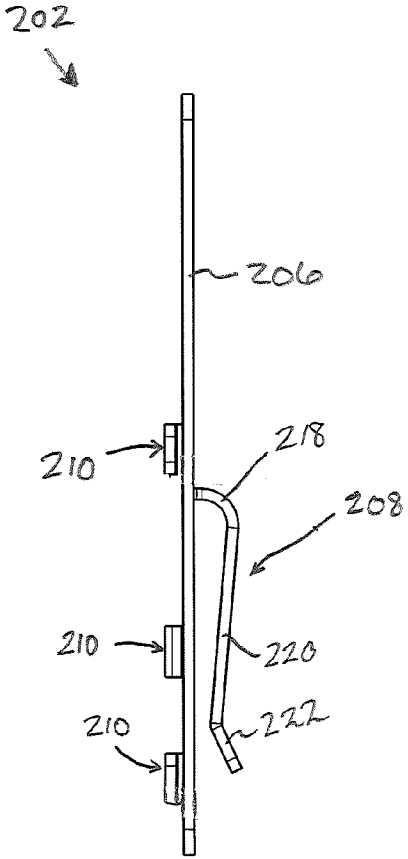
FIG. 8 depicts a side view of the primary clip of the optical tape clip of FIG. 5.

Alignment targets (212) comprise three separate targets: a lower target (224), an upper target (226), and a center target (228). In the present example, the spacing between each of the targets is about 0.375 inches. Referring to FIG. 5, secondary clip (204) comprises crossbar (230) that extends toward alignment targets (212). As will be discussed further below, secondary clip (204) is adjustably connected with primary clip (202) such that crossbar (230) can be positioned between lower target (224) and upper target (226). In instances where the floors at the landings are not even with the landings, for example where the finished flooring sits 0.375 inches below the landing, secondary clip (204) can be connected with primary clip (202) such that crossbar (230) aligns with upper target (226) instead of center target (228). This way, as will be described in greater detail below, the elevator positioning system (100) can control elevator car (30) to stop even with the floor level such that there is no trip hazard when entering or exiting elevator car (30). A similar adjustment in the other direction may also be made, e.g., if elevator car (30) lands above the sill of a landing (50) and needs to be adjusted downward to be even with landing (50). In view of the teachings herein, other ways to adjustably connect secondary clip (204) with primary clip (202) to provide fine control of elevator positioning will be apparent to those of ordinary skill in the art.

Figure 11:
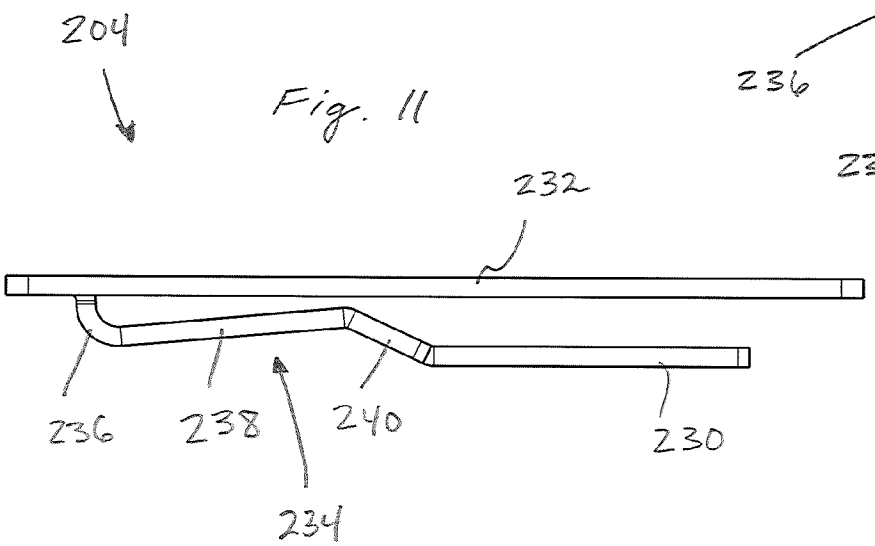
FIG. 11 depicts a top view of the secondary clip of the optical tape clip of FIG. 5.
Figure 13:
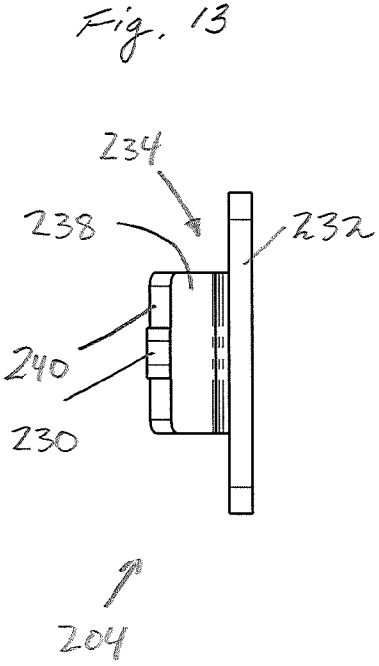
FIG. 13 depicts a side view of the secondary clip of the optical tape clip of FIG. 5.
Figure 12:
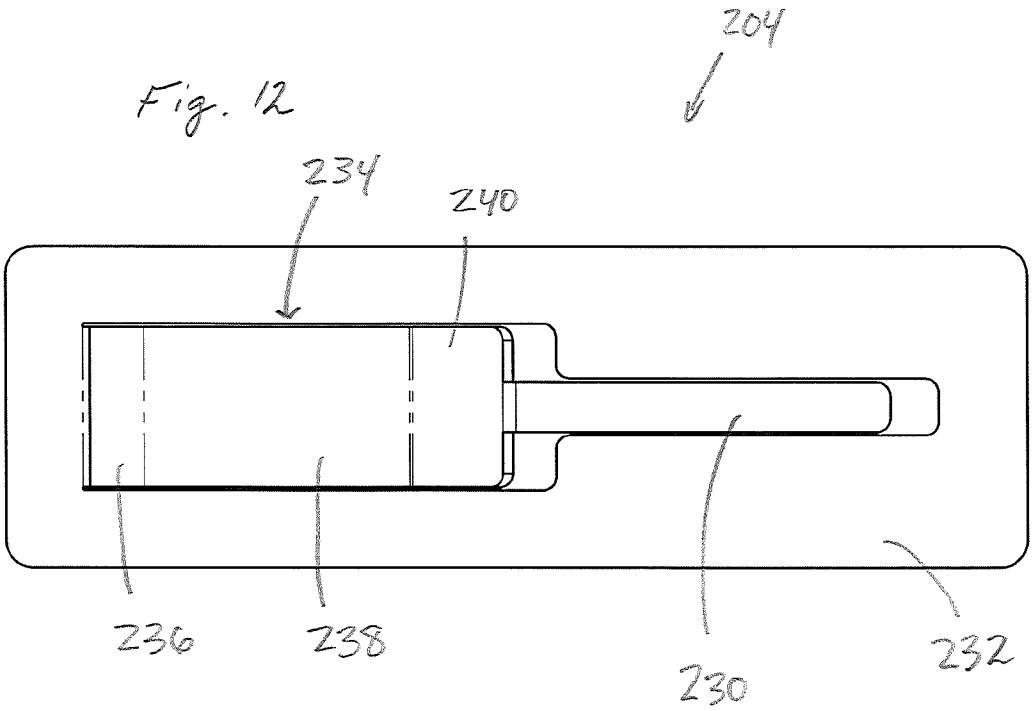
FIG. 12 depicts a front view of the secondary clip of the optical tape clip of FIG. 5.

FIGS. 11-13 depict secondary clip (204) separate from primary clip (202). Secondary clip (204) comprises plate (232), crossbar (230), and arm (234). Secondary clip (204) is constructed of stainless steel in the present example, although other materials may be used and may include other metals such as aluminum, or other materials such as plastics. In view of the teachings herein, other materials for secondary clip (204) will be apparent to those of ordinary skill in the art. Arm (234) comprises a punched and bent section of plate (232). As used throughout, when describing a part as punched or punched and bent, it should be understood that other descriptions and terms may equally apply. For instance, arm (234) can be considered a stamped out section of plate (232) or a cut-out section of plate (232). In either or both of these cases, the stamped out or cut-out section is bent to be formed into arm (234).

Arm (234) comprises curved portion (236), first angled portion (238), and second angled portion (240). Connected with second angled portion (240) and also formed from punched and bent portion of plate (232) is crossbar (230). In the present example, crossbar (230) has a width of about 0.118 inches, but other widths may be used as well. Referring to FIG. 11, curved portion (236) and first angled portion (238) define a first space (242) between arm (234) and plate (232). Furthermore, second angled portion (240) and crossbar (230) define a second space (244) between arm (234) and plate (232). First space (242) is configured such that arm (234) can securely grasp primary clip (202). When attached, as shown in FIG. 5, arm (234) is located on one side of primary clip (202) while the remainder of secondary clip (204) is located on the other side of primary clip (202). Second space (244) is configured to remain spaced from plate (206) of primary clip (202) when secondary clip (204) is connected with primary clip (202) such that optical tape (110) can be positioned between crossbar (230) and plate (206) of primary clip (202).

FIGS. 14-17 depict another exemplary primary clip (302) of another exemplary optical tape clip. Primary clip (302) is configured similarly to primary clip (202) except with an extended upper portion (304) or extended height compared to primary clip (202). Extended upper portion (304) provides an area for attaching secondary clip (204). Attachment of secondary clip (204) is similar to that described above with attachment of secondary clip (204) to primary clip (202) of optical tape clip (200). In the present example, primary clip's (302) extended upper portion (304) allows secondary clip (204) to be mounted higher and at a position where sensor (106) can see or detect crossbar (230) of secondary clip (204) when elevator car (30) is located at landing (50) of the first floor level. In some arrangements, where sensor (106) is mounted to a portion of door operator assembly (108) as shown in FIG. 2, and with a primary clip mounted to hoistway header (102), if the shorter primary clip (202) is used at landing (50) at the first floor level, then sensor (106) can be positioned above an attached secondary clip (204) where sensor (106) cannot see or detect crossbar (230) of secondary clip (204). This same result does not occur at the other floors where the elevator car (30) travels up or down past optical tape clip (200), even though when elevator car (30) is positioned at a given landing (50), sensor (106) is located above the nearest optical tape clip (200). It is only at the bottom floor where sensor (106), with its described mounting location and arrangement, would sit above optical tape clip (200) and effectively never be in a position across from optical tape clip (200) to detect the interruption in optical tape (110). Note that the description of "first floor" above, in this sense, is intended to signify the bottom floor of a particular elevator arrangement. The use of taller primary clip (302) at the bottom floor compensates for the above-described phenomenon. Thus for hoistway header (102) at landing (50) of the first floor level (bottom floor level), primary clip (302) can be used instead of primary clip (202). It is further understood that the combination of primary clip (302) with secondary clip (204) comprises exemplary optical tape clip (300) as shown in FIG. 3.

Figure 14:
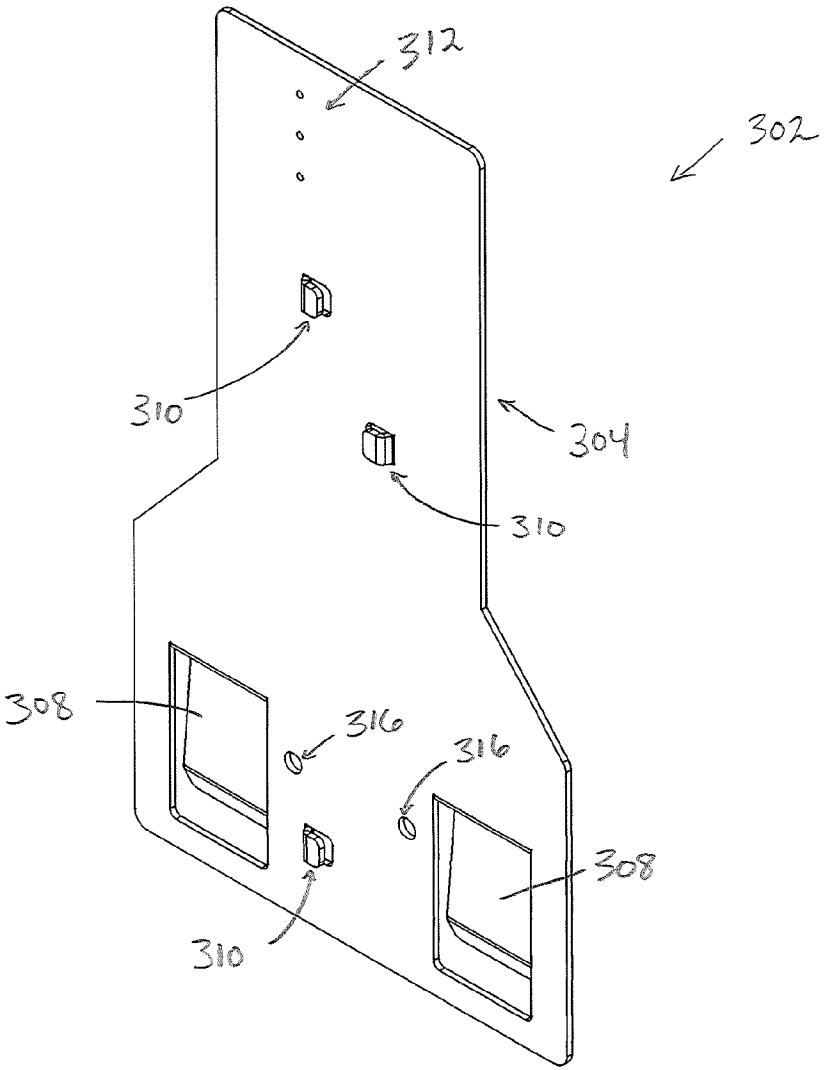
FIG. 14 depicts a perspective view of another exemplary primary clip of another exemplary optical tape clip.
Figure 16:
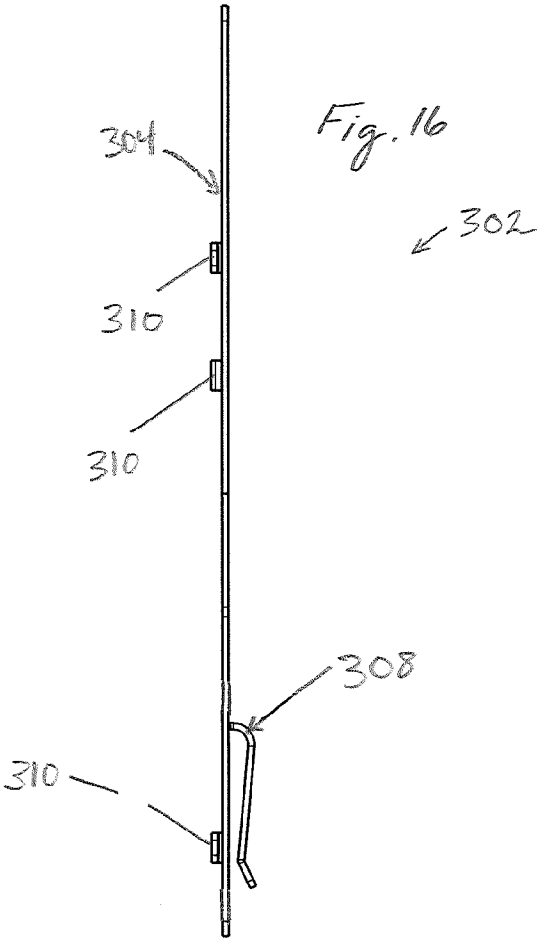
FIG. 16 depicts a side view of the primary clip of FIG. 14.
Figure 15:
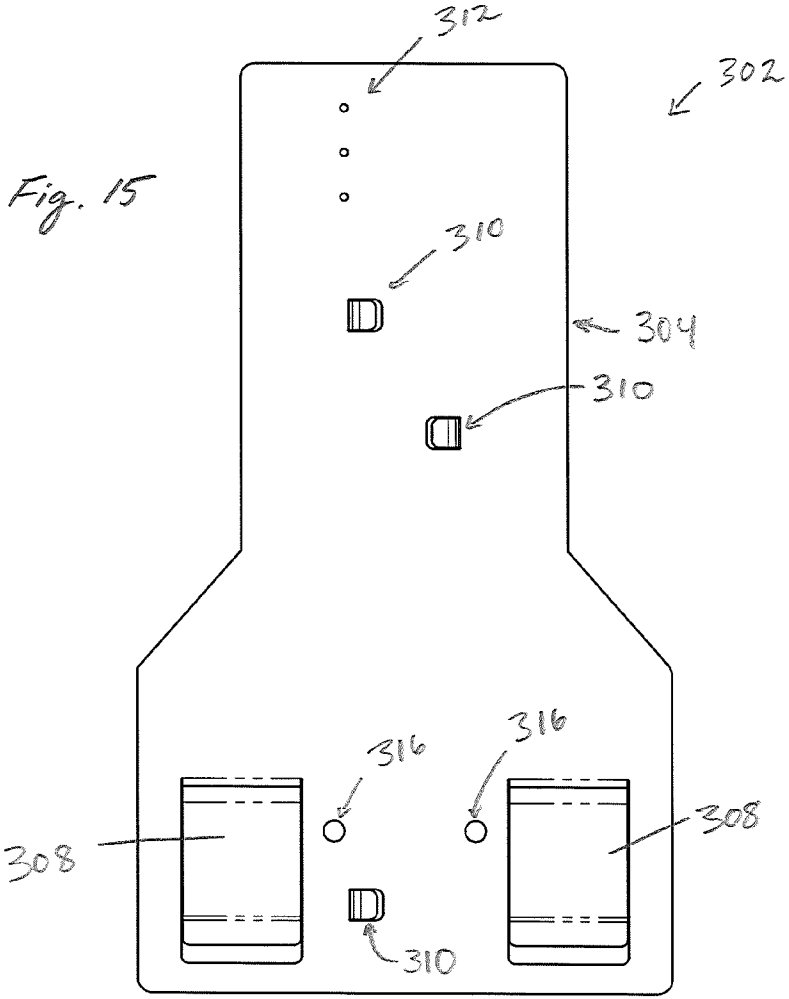
FIG. 15 depicts a front view of the primary clip of FIG. 14.
Figure 17:
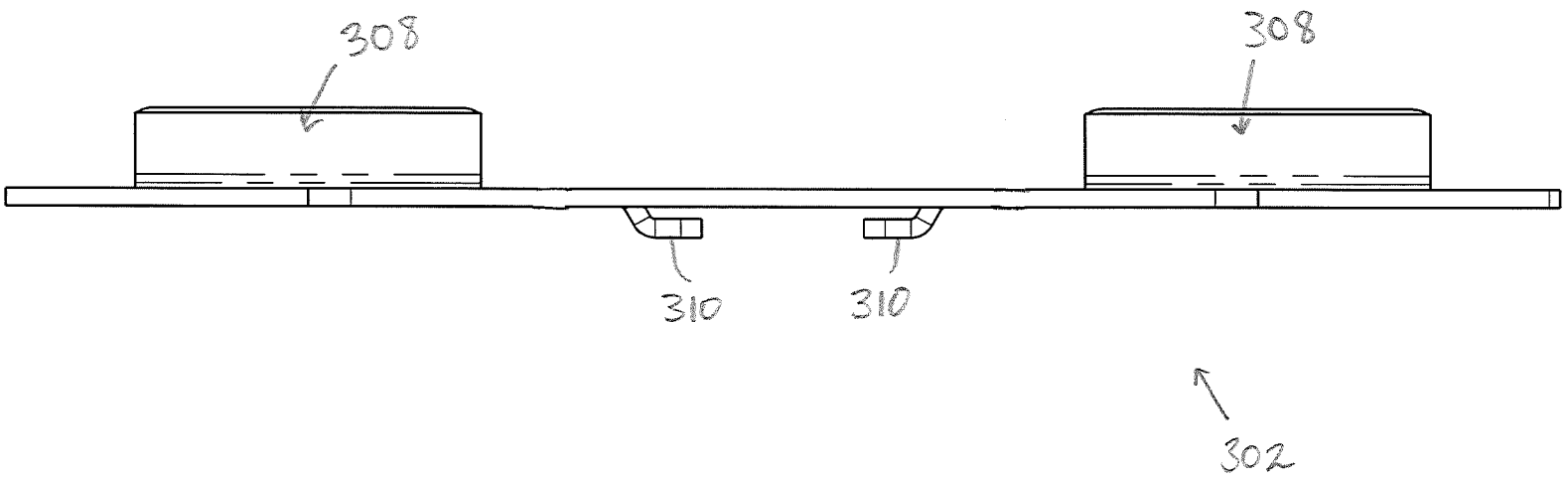
FIG. 17 depicts a top view of the primary clip of FIG. 14.

Primary clip (302) also comprises arms (308), guides (310), alignment targets (312), and holes (316). Arms (308) are comparable to arms (208) of primary clip (202) and the description of arms (208) above applies equally to arms (308). Guides (310) are comparable to guides (210) of primary clip (202) and the description of guides (210) above applies equally to guides (310). As seen from FIGS. 14 and 15 however, guides (310) are spaced differently compared to guides (210), with the two upper guides (310) being located on extended upper portion (304) and remaining guide (310) being located on primary clip (304) between arms (308). Alignment targets (312) are comparable to alignment targets (212) of primary clip (202) and the description of alignment targets (212) applies equally to alignment targets (312). Again, as shown in FIGS. 14 and 15 alignment targets (312) are located on extended upper portion (304). Finally holes (316) are comparable to holes (216) of primary clip (202) and the description of holes (216) applies equally to holes (316).

Exemplary Operation of Elevator Positioning System with Optical Tape

When elevator positioning system (100) is arranged as described above, optical tape (110) is mounted in hoistway (10) along the travel path of elevator car (30) and sensor (106) is positioned to sense or detect optical tape (110) as sensor (106) moves with elevator car (30) between landings (50). As shown and described above, optical tape clips (200) are mounted near landings (50) at each floor to hoistway headers (102), with optical tape clip (300) being used at landing (50) of first floor level. When elevator car (30) is moving between landings (50), sensor (106) senses or detects optical tape (110) and observes no interruptions in optical tape (110) until elevator car (30) approaches and/or passes installed optical tape clip (200) or optical tape clip (300) at the point where crossbar (230) passes in front of optical tape (110) between optical tape (110) and sensor (106). At this point, sensor (106) detects an interruption in optical tape (110) when it senses or detects crossbar (230). The detected interruption in optical tape (110) serves as a signal to elevator controller (101) that is also a component of elevator positioning system (100) as shown schematically in FIG. 5. Moreover, the precise known placement of optical tape clips (200, 300) within hoistway (10) and the known location of landings (50) can be inputs to elevator controller (101) such that the detected interruptions in optical tape (110) allow for elevator controller (101) to control elevator car (30) to stop at a programmed count either below or above the point the interruption in optical tape (110) is detected by sensor (106). The programmed count can be, for example, a distance measurement. This then allows for elevator car (30) to be stopped in alignment with landing (50) such that the floor of elevator car (30) exactly or substantially aligns with the floor of landings (50).

Elevator positioning system (100) is capable of calculating, accounting for, and/or compensating for building compression phenomenon that can occur in multi-story buildings. In such instances where building compression has occurred after the installation of elevator positioning system (100), even with such compression, elevator positioning system (100) is still able to align elevator car (30) with landings (50). By way of example and not limitation, after building (20) has been constructed, building (20) may undergo a compression due to settling and other factors apparent to those of ordinary skill in the art in view of the teachings herein. In the above example, hoistway headers (102) are associated with landings (50), and hoistway headers (102) are connected between entrance struts (104) in hoistway (10). Struts (104) are connected to the front wall of hoistway (10) and thus undergo a similar amount of compression as building (20) and its landings (50) experience. Likewise, hoistway headers (102) are impacted by the compression similarly as hoistway headers (102) are connected with struts (104). As time progresses and building compression occurs, the position of landings (50) relative to nearby hoistway headers (102) installed between struts (104) is largely unchanged. At the same time the relative distance between one hoistway header (102) and the next hoistway header (102) (or one landing (50) and the next landing (50)) may have changed due to building compression. Because, in the present example, positioning elevator car (30) can be based on measuring the relative movement from one landing (50) to another landing (50) after compression by detecting interruptions associated with optical tape clips (200, 300) installed at hoistway headers (102), along with the fact that optical tape (110) can freely move vertically and thus its configuration for proper functioning is not disturbed by building compression, the system can continue to properly position and align elevator car (30) with landings (50) even though building compression may have occurred.

With respect to measuring and compensating for building compression, sensor (106) can be used to detect relative changes in the distances between the various mounted optical tape clips (200, 300) in the system, e.g., measuring the distance between an optical tape clip (200) on one hoistway header (102) compared to another optical tape clip (200) on another hoistway header (102). This data can be captured at some desired frequency and processed to evaluate building compression over time and how various regions of building (20) may be affected differently by building compression. In other words, differences in measurements over time between optical tape clips (200, 300) on hoistway headers (102) provides information indicating the location and amount of compression a building has experienced. Furthermore, elevator controller (101) can be updated as needed based on the compression data gathered over time to keep elevator positioning system (100) operating properly to align elevator car (30) with landings (50). Such updates to elevator controller (101) can include updating or adjusting a programmed count either below or above a detected optical tape clip (200, 300) at a hoistway header (102) for stopping elevator car (30).

In some versions the preferred maximum spacing between clips is 13 feet. Where applications would have optical tape clips (200) spaced greater than 13 feet (e.g., where a structure would have a floor-to-floor span greater than 13 feet), a mounting bracket (116) (also referred to as an entrance-mount intermediate bracket) can be used to provide intermediate stability to optical tape (110). In this instance, primary clip (202) is attached with mounting bracket (116) to aid in stabilizing optical tape (110), but secondary clip (204) is not required. This 13 foot limit is an approximate recommendation and is not required to be precisely 13 feet in all cases. The actual span limit will be dictated by the application and how much optical tape (110) sway is occurring. Based on the desire to control the sway, mounting brackets (116) and primary clips (202) can be added as described above.

In some cases, crossbar (230) of secondary clip (204) can be considered a type of detectable member. This is so, even when crossbar (230) itself is not directly sensed or detected, but rather crossbar (230) represents a portion of secondary clip (204) that extends across primary clip (202) and obstructs the sensor's view of another detectable member such as optical tape (110). In this sense, it is the absence of the sensor seeing optical tape (110) that shows up as the detection, this absence being caused by crossbar's (230) obstructing sensor's (106) view of optical tape (110). In other words, the detection is the interruption in the sensed optical tape (110) that is caused by crossbar (230), which can be considered a detectable member. Thus a detectable member is not limited to only those things that are positively or affirmatively detected. Instead detectable members can include such positive or affirmative detections, but can also include those things that may cause an interruption or break or absence is something that is being detected or sensed.

Exemplary Alternative Mounting Arrangement with Optical Tape

Figure 18:
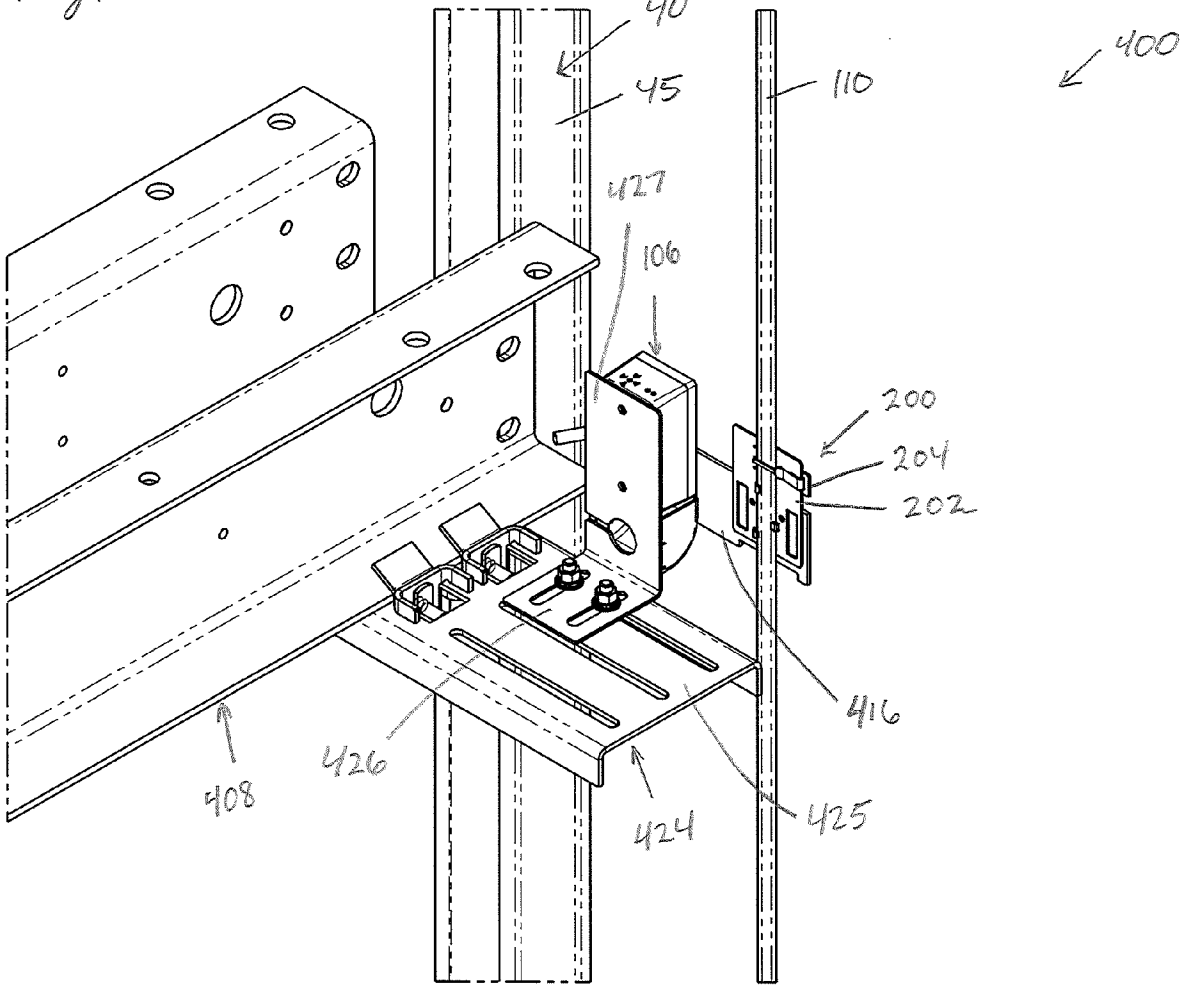
FIG. 18 depicts a partial perspective view of an exemplary hoistway showing another optical tape clip mounting configuration.
Figure 20:
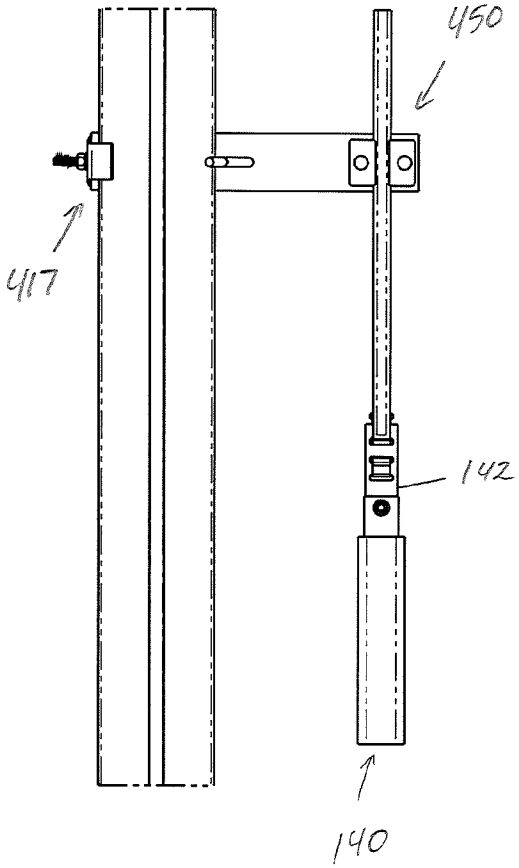
FIG. 20 depicts a side view of a bottom portion of the hoistway of FIG. 18.
Figure 19:
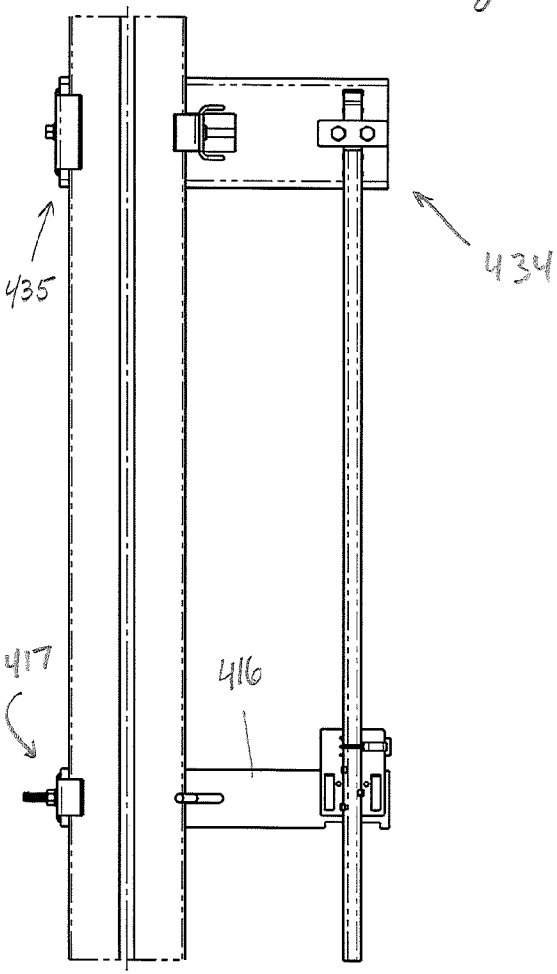
FIG. 19 depicts a side view of a top portion of the hoistway of FIG. 18.

The mounting arrangement described above can be used for new elevator installations in some versions. In some other versions an alternate mounting arrangement can be used, e.g., for a modernization installation where an elevator positioning system as described here is installed into an existing elevator system. FIGS. 18-20 illustrate an exemplary alternative mounting arrangement for elevator positioning system (400), similar to elevator positioning system (100) described above, using optical tape (110), optical tape clips (200), and sensor (106) but mounted in this version in an orientation that is generally perpendicular to the orientation described above with reference to FIGS. 1-3. In the illustrated versions here as before, elevator positioning system (400) is used with elevator car (30) disposed in hoistway (10). In this alternate arrangement, optical tape clips (200) are mounted to mounting brackets (416) attached to rails (40) but in a fashion where mounting brackets (416) and optical tape clips (200) extend generally perpendicular to the openings for accessing landings (50). In this configuration, mounting brackets (416) with attached optical tape clips (200) can be positioned along rails (40) at locations even with each hoistway header.

Sensor (106) is attached to crosshead (408) via crosshead bracket assembly (424) that comprises first portion (425), second portion (426), and third portion (427). Crosshead (408) extends between rails (40) and crosshead bracket (424) extends generally perpendicular to rails (40). Optical tape clips (200) are configured to receive and help stabilize optical tape (110) substantially in a desired position running along a length of hoistway (10), as described above with respect to elevator positioning system (100). In this mounting arrangement, a surface of optical tape (110) substantially faces the direction of sensor (106), which is configured to sense optical tape (110) and any interruptions such as those caused by crossbar (230) of secondary clips (204), in a manner similar to that described above for elevator positioning system (100).

Rails (40) comprise first rail portions (45) to which mounting brackets (416) are configured to attach. In the present example, mounting brackets (416) attached to rails (40) at first rail portions (45) using a clamp mechanism (417) as shown in FIG. 19. Still other ways to attach mounting brackets (416) to rails (40) will be apparent to those of ordinary skill in the art in view of the teachings herein. Optical tape clips (200) are configured to attach to mounting brackets (416) in the same or similar fashion as described above with respect to hoistway headers (102) or mounting brackets (116). Similarly, optical tape (110) is positionable along optical tape clips (200) when attached to mounting bracket (416) in the same or similar fashion as described above.

In the alternate mounting arrangement described here, in some versions at the first floor level, mounting bracket (416) attaches to rail (40) at a position even with hoistway header (102) at the first floor level. In such a case, extended primary clip (302) would be used at the first floor level such that sensor (106) and secondary clip (204) will be relatively positioned so that sensor (106) can see or detect crossbar (230) of secondary clip (204). This setup is largely for the same reasons as discussed above with respect to the other arrangement discussed. Still yet, in other versions using the alternate mounting configuration, it is possible to adjust the placement of mounting bracket (416) at the first floor level such that a standard sized primary clip (202) may be used at the first floor level. In such a case, at the first floor level, mounting bracket (416) would be attached to rail (40) above hoistway header (102) at the first floor level. In this approach, the location of mounting bracket (416) at the first floor is used as the adjustment to ensure that sensor (106) is located relative to secondary clip (204) at the first floor level such that sensor (106) is able to see and detect crossbar (230).

When installed in this illustrated alternate mounting arrangement, a surface of optical tape (110) faces toward a side of elevator car (30). Elevator car (30) includes elevator crosshead (408) to which sensor (106) is attached as mentioned above. First portion (425) of crosshead bracket assembly (424) is configured to attach to crosshead (408), transversely projecting from crosshead (408), via fasteners such as screws, bolts, clamps, and the like. Second portion (426) of crosshead bracket assembly (424) connects with first portion (425) via one or more bolts that extend through apertures. Third portion (427) of crosshead bracket assembly (424) connects with second portion (426) and upwardly projects from first and second portions (425, 426). A rear portion of sensor (106) is configured to attach to third portion (427) or crosshead bracket assembly (424) such that a front, detecting portion of sensor (106) faces toward positioned optical tape (110), as shown in FIG. 18.

FIGS. 19 and 20 illustrate how optical tape (110) is mounted at top and bottom portions of rails (40). FIG. 19 shows a top portion including top mounting bracket (434) that includes fastener (435) in the form of a clamp sized and shaped to be securely positioned about rail (40). Top mounting bracket (434) may receive optical tape (110) and be constructed in a manner similar to top mounting bracket (134) described above and may also include clamp (136) as described above.

FIG. 20 shows a bottom portion of rails (40) showing weight component (140) and bottom mounting plate (142), which are described above with respect to elevator positioning system (100). Bracket (450) is configured to receive optical tape (110) and is configured to be disposed substantially near and above bottom mounting plate (142) to aid in stabilizing optical tape (110) and weight component (140) from swaying. Bracket (450) is fastened to rail (40) using clamp (417) the same or similar to the way mounting bracket (416) connects with rails (40).

Elevator positioning system (400) operates in a manner similar to elevator positioning system (100) described above. In the present example of elevator positioning system (400), optical tape clips (200, 300) are mounted to rails (40) via mounting brackets (416). Mounting brackets (416) are positioned such that optical tape clips (200) are located at every floor landing such that the vertical distance between mounting brackets (416) is equal to the floor-to-floor height. Again, optical tape clip (300) may be used at the first floor level as discussed above. Sensor (106) moves with crosshead (408) which moves with elevator car (30) through hoistway (10). As sensor (106) travels it detects optical tape (110) and any interruptions when passing by crossbar (230) of secondary clips (204) of optical tape clips (200, 300). This then signals elevator controller (101) as described further previously.

In versions described above, optical tape clip (200, 300) comprises a dual clip design or clip-on-clip design where secondary clip (204) attaches with primary clip (202, 302) to form optical tape clip (200, 300). Furthermore in the illustrated versions, each of primary clip (202, 302) and secondary clip (204) are comprised of a single piece of cut and bent material. In other versions primary clips (202, 302) and secondary clips (204) may be made from more than one piece where such pieces are joined together or commonly attached with primary clips (202, 302) to form optical tape clips (200, 300). In view of the teachings herein, other ways to construct optical tape clips (200, 300) will be apparent to those of ordinary skill in the art.

Exemplary Elevator Positioning System with Reflector Target

Figure 21:
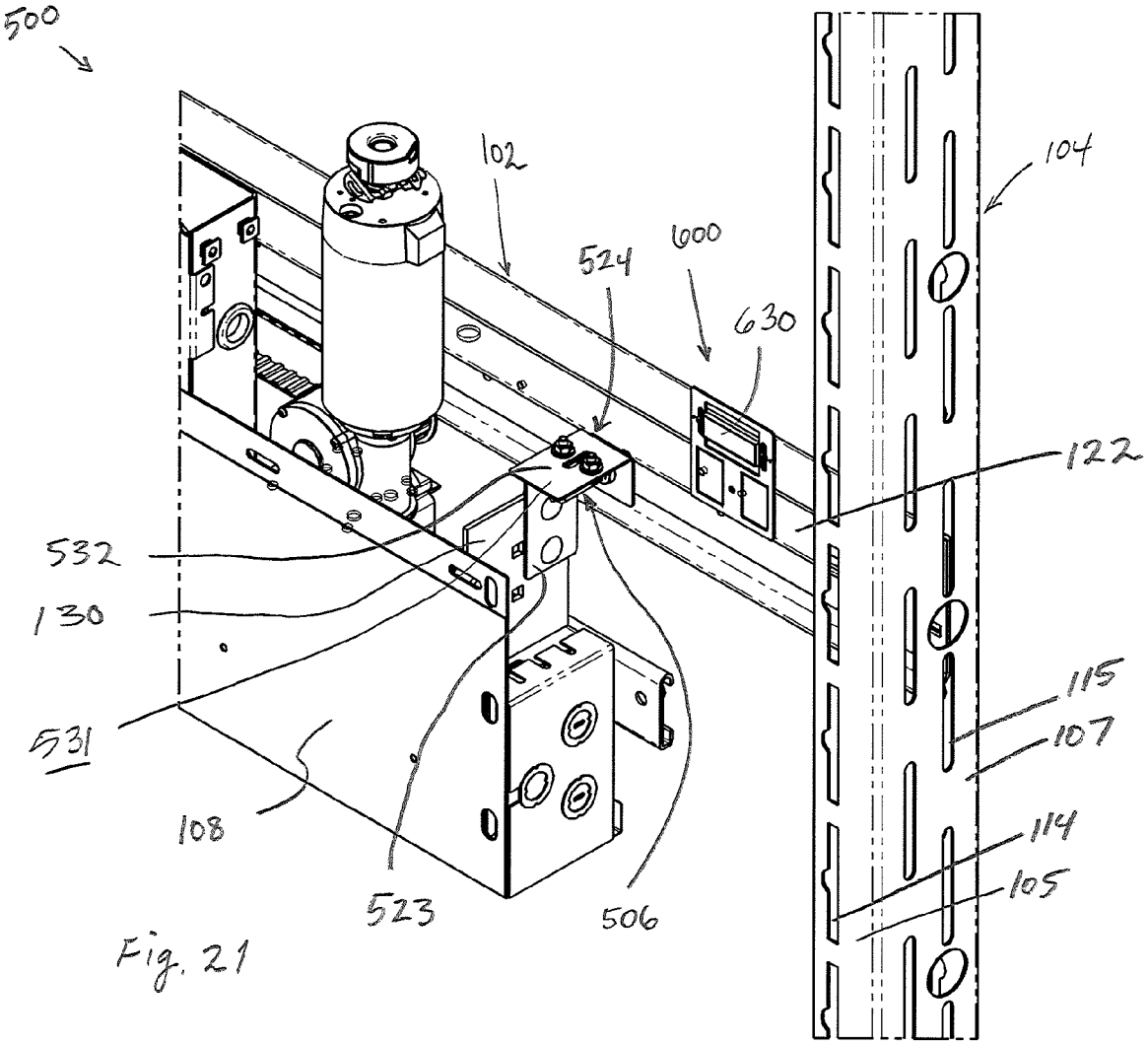
FIG. 21 depicts a partial perspective view of an exemplary hoistway showing an exemplary reflector clip assembly and other components installed within a hoistway.

FIG. 21-27 depict another elevator positioning system (500) that uses a reflector target instead of an optical tape that extends the length of the elevator car (30) travel path. FIG. 21 depicts a mounting configuration for elevator positioning system (500) where reflector clip assemblies (600) are mounted to hoistway headers (102) at each landing of an elevator's travel path. In this version, the mounting of reflector clip assemblies (600) is the same as the mounting of optical clips (200) as discussed with reference to FIGS. 1 and 2 above. The difference being that optical tape clips (200) and optical tape clip (300) are replaced with reflector clip assemblies (600) and reflector clip assembly (700).

Still referring to FIG. 21, exemplary elevator positioning system (500) comprises hoistway header (102), entrance struts (104), sensor (506), elevator door operator assembly (108), and reflector clip assemblies (600). Hoistway header (102) is a component of a hoistway frame that is connected to hoistway (10). In the present example, hoistway header (102) is disposed near the top of an entryway to one of landings (50). As will be understood by those of ordinary skill in the art in view of the teachings herein, the entryway comprises an opening that can be substantially similarly sized to the opening defined by the one or more doors of elevator car (30).

Figure 22:
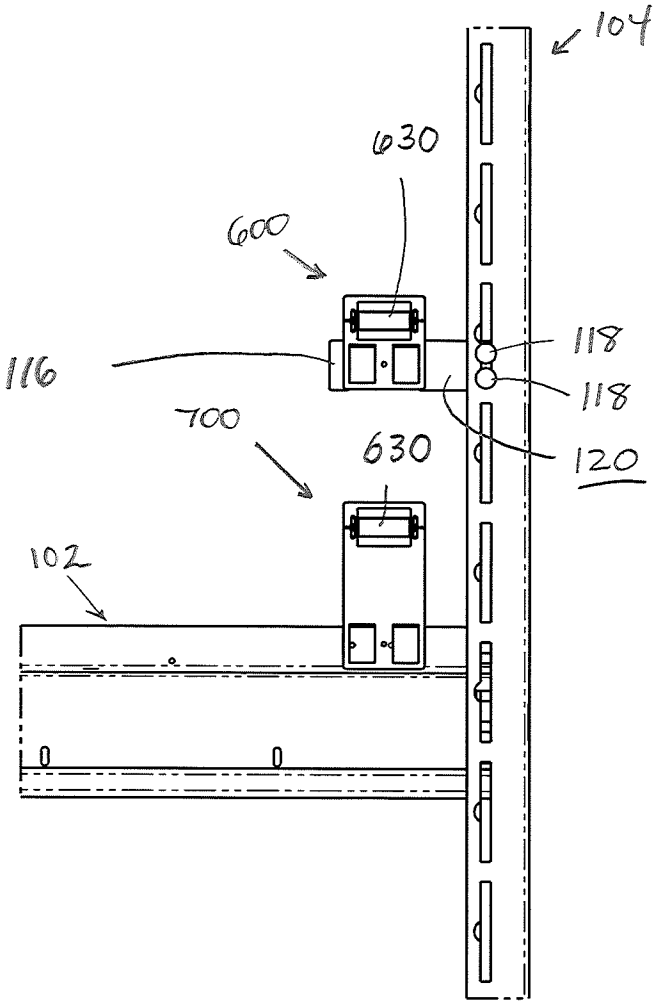
FIG. 22 depicts a side view of a portion of the hoistway of FIG. 21.
Figure 23:
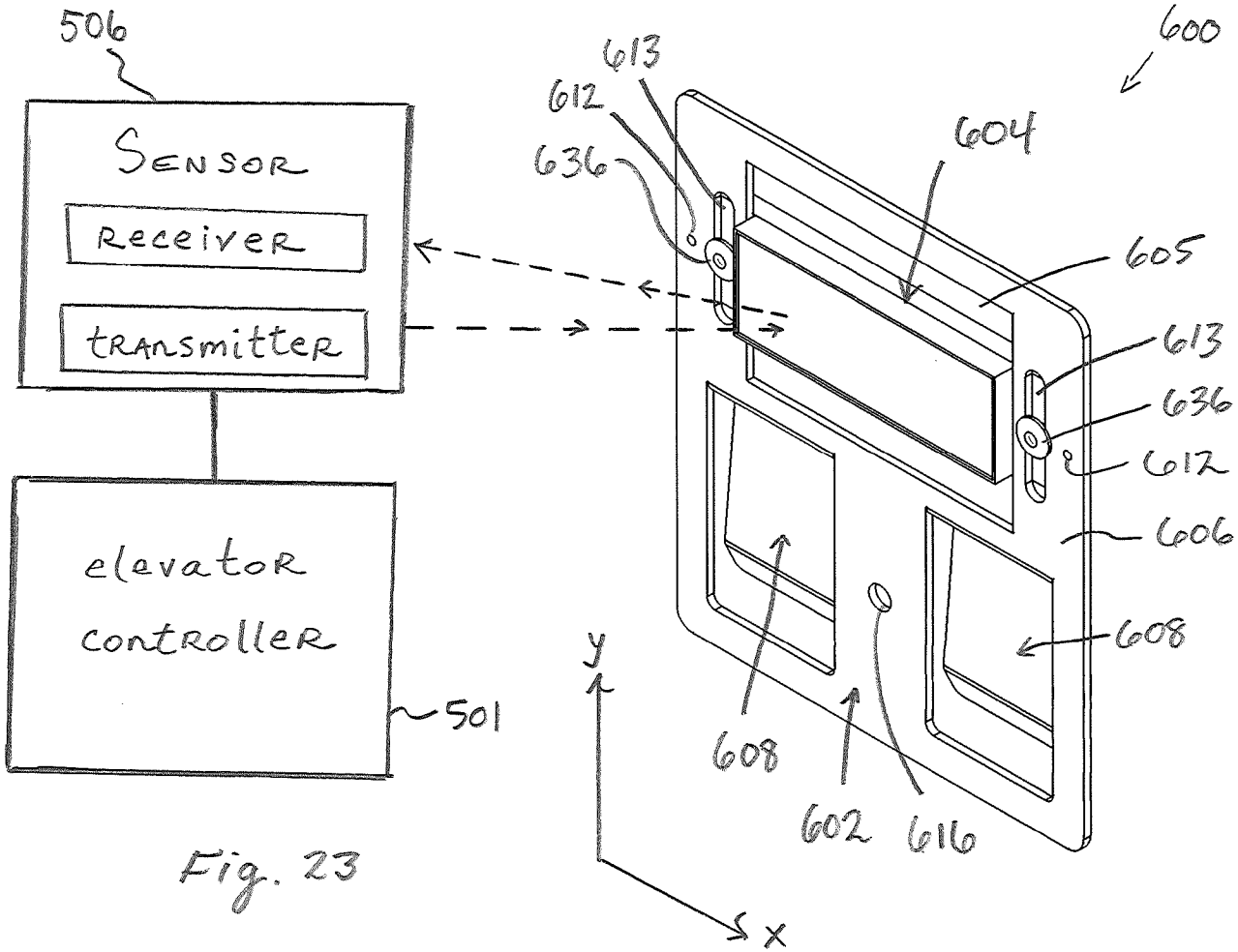
FIG. 23 depicts a perspective view of an exemplary reflector clip assembly as shown in FIG. 21, with a sensor and elevator controller shown schematically.
Figure 24:
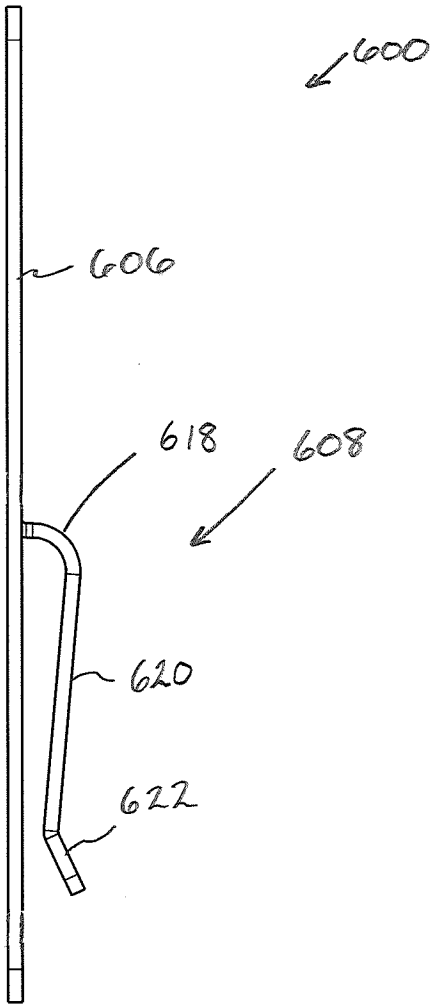
FIG. 24 depicts a side view of the clip member of the reflector clip assembly of FIG. 23.

Hoistway header (102) includes bent portion (122) that, in the present example but not required in all examples, extends along the length of hoistway header (102). Struts (104) comprise first strut portion (105) including slots (114) and second strut portion (107) positioned, in the illustrated version, generally perpendicular to first strut portion (105) with second strut portion (107) including slots (115). As shown in FIG. 22, optional mounting brackets (116) are configured for selective attachment with struts (104). Mounting brackets (116) include connectors (118) that are sized and shaped to be received through an enlarged portion of slots (114) and are slidable along slots (114) to securely positioned mounting bracket (116) to strut (104). When secured to struts (104), mounting brackets (116) transversely project from struts (104) such that a first surface (120) of mounting bracket (116) faces elevator car (30). Mounting brackets (116) are optional features that provide a location for attaching a reflector clip assemblies (600) for elevators with reverse entrances.

Elevator car (30) includes elevator door operator assembly (108) to which sensor (506) is attached in the present example. Elevator door operator assembly (108) is generally located above and directly or indirectly connected with the elevator doors so as to open and close the doors in operation. In view of the teachings herein, those of ordinary skill in the art will understand suitable configurations for and operability of elevator door operator assembly (108).

In the present example, sensor (506) is a photoelectric sensor that includes a transmitter to transmit light and a receiver to receive light that is reflected off of e.g., reflector target (630). In some versions, an exemplary sensor (506) is a barrel-mount photoelectric sensor available from Banner Engineering Corp. as model M12PLP. In view of the teachings herein, other suitable sensors will be apparent to one of ordinary skill in the art. By way of example only, and not limitation, in some versions sensor (506) is spaced about 4 inches from reflector targets (630) of reflector clip assemblies (600). Elevator positioning system (500) can be configured such that that when sensor (506) detects the transmitted light from reflector target (630), it is established that sensor (506) was adjacent to the reflector target (630) of reflector clip assembly (600). With the information on the location of sensor (506) relative to elevator car (30), and the information on the location of reflector clip assembly (600) relative to landings (50), the position of elevator car (30) can be controlled, and specifically elevator car (30) can be aligned with floor landings (50) during operation when stopping elevator car (30) at a desired landing (50).

In the present example, sensor (506) connects with elevator door operator assembly (108) via bracket (524). A first portion (523) of bracket (524) is configured to attach to a portion (130) of elevator door operator assembly (108) via fastener components such as bolts, screws, etc. Second portion (532) of bracket (524) projects from first portion (523) such that a first surface (531) of second portion (532) faces upward and an opposing second surface (not shown) faces downward. Sensor (506) is configured to attach to the second surface of second portion (532) of bracket (524) such that a front, transmitting and receiving portion of sensor (506) faces toward reflector clip assemblies (600) as shown in FIG. 21.

Reflector targets (630) are made from a durable and dimensionally stable material that is suitable for reflecting the light transmitted from sensor (506) back to the receiver of sensor (506). In some versions reflector target (630) are constructed of acrylic or aluminum. In some versions suitable reflector targets (630) are available from Banner Engineering Corp. under their line of retroreflector products. Other suitable materials, construction, and configuration for reflector targets (630) will be apparent to those of ordinary skill in the art in view of the teachings herein.

FIGS. 23-27 illustrate exemplary reflector clip assembly (600) and reflector clip assembly (700). In at least some versions, reflector clip assemblies (600, 700) are considered a type of positioning members as they aid in positioning elevator car (30). Reflector clip assembly (600) comprises clip member (602) and reflector target assembly (604). Clip member (602) comprises plate (606), arms (608), and alignment targets (612). Plate (606) has a mostly flat surface and can be constructed of a metal such as stainless steel. Of course plate (606) can be constructed of other materials such as plastic, aluminum, and other materials that will be apparent to those of ordinary skill in the art in view of the teachings herein. In the present example, plate (606) has dimensions of about 3.25 inches wide (as shown in the X direction in FIG. 23) by 4.75 inches high (as shown in the Y direction in FIG. 23). Plate (606) optionally includes hole (616) that can be used in some version with fasteners to attach plate (606) to another structure, although use of hole (616) and fasteners in this manner is not required.

Arms (608) represent resilient grasping members that are used to attach reflector clip assembly (600) to other structures. For instance, in the present example, arms (608) are configured to grasp a portion of hoistway header (102), more specifically bent portion (122) of hoistway header (102). Each arm (608) includes curved portion (618) and first and second angled portions (620, 622) that are resiliently biased such that second angled portion (620) wants to return to or maintain a position generally adjacent plate (606). With the resilient nature of arms (608), reflector clip assembly (600) is attachable to a mounting feature, e.g., hoistway header (102) and/or mounting bracket (116). In the present example and other versions, reflector clip assembly (600) can be installed on hoistway headers (102) and/or mounting brackets (116) without the use of tools. In the present example, arms (608) comprise punched sections formed from plate (606). These punched sections are bent to the shape shown in the illustrated version and described above. In some other versions, arms (608) could be made as separate pieces from plate (606) and then attached to plate (606) by welding or other fastening means.

Alignment targets (612) comprise holes located on each side of reflector target assembly (604). In other versions alignment targets (612) can comprise recessed portions or raised portions instead of holes. Alignment targets (612) are configurable such that when reflector clip assembly (600) is connected with hoistway header (102) at a floor landing (50), alignment targets (612) indicate an initial floor position setting. Alongside alignment targets (612), clip member (602) comprises vertical slots (613). Vertical slots (613), in the present example, provide about 0.375 inches of adjustment above and below alignment targets (612) for positioning and securing reflector target assembly (604). In this way reflector target assembly (604) is adjustably connected with clip member (602) such that reflector target (630) can be positioned up to 0.375 inches below alignment target (612) or up to 0.375 inches above alignment target (612). In instances where the floors at the landings are not even with the landings, for example where the finished flooring sits 0.375 inches below the landing, reflector target assembly (604) can be connected with clip member (602) such that reflector target (630) is shifted upward along slots (613) instead of centered within slots (613). This way, as will be described in greater detail below, the elevator positioning system (500) can control elevator car (30) to stop even with the floor level such that there is no trip hazard when entering or exiting elevator car (30). A similar adjustment in the other direction may also be made, e.g., if elevator car (30) lands above the sill of a landing (50) and needs to be adjusted downward to be even with landing (50). In view of the teachings herein, other ways to adjustably connect reflector target assembly (604) with clip member (602) to provide fine control of elevator positioning will be apparent to those of ordinary skill in the art.

Figure 25:
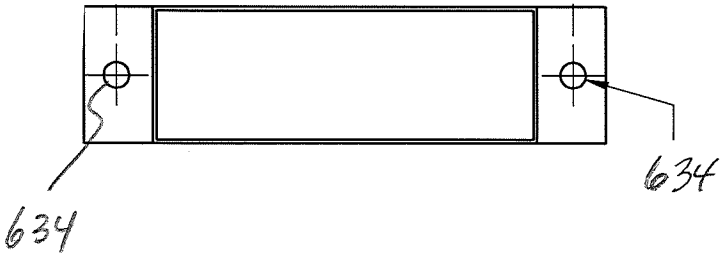
FIG. 25 depicts a front view of a reflector target assembly of the reflector clip assembly of FIG. 23.

FIG. 25 depicts reflector target assembly (604) separate from clip member (602). Reflector target assembly (604) can be considered a type of detectable member and comprises backing plate (632) and reflector target (630). In the present example, reflector target (630) and backing plate (632) are joined together to form a whole. In some other versions, backing plate (632) could be omitted altogether. As mentioned above, reflector target (630) is constructed of acrylic in some versions and aluminum in other versions. In view of the teachings herein, other materials for reflector target (230) will be apparent to those of ordinary skill in the art. Backing plate (632) is constructed of plastic in the present example, but in other versions could be constructed of stainless steel, aluminum, ceramic, or other material. In view of the teachings herein, other materials for backing plate (632) will be apparent to those of ordinary skill in the art. Backing plate (632) comprises holes (634) on each side and holes (634) are configured to align with vertical slots (613) of clip member (602). Reflector clip assembly (600) further comprises rivets (636) configured to extend through vertical slots (613) and be received within holes (634) of backing plate (632). In the present example, rivets (636) securely retain reflector target assembly (604) in position relative to vertical slots (613) and clip member (602). However, rivets (636) are configured such that an installer can apply a sufficient force by hand to vertically adjust the position of reflector target assembly (604) plus or minus 0.375 inches along vertical slots (613) as described above. In some other versions rivets (636) can be replaced with screws, pins, nails, or bolts.

Figure 26:
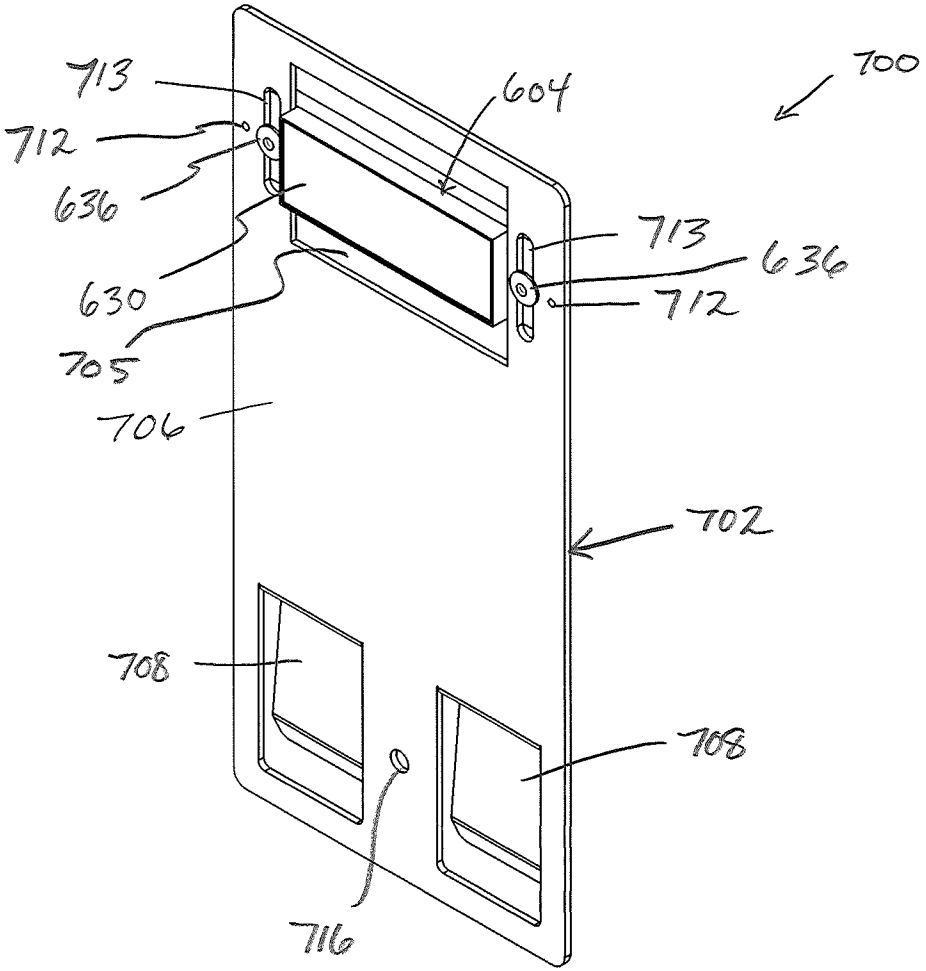
FIG. 26 depicts a perspective view of an elongated exemplary reflector clip assembly.
Figure 27:
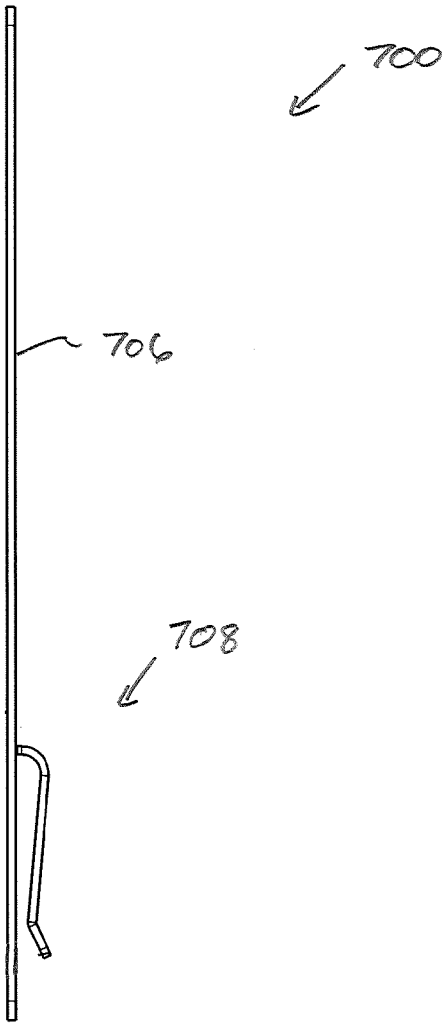
FIG. 27 depicts a side view of the clip member of the reflector clip assembly of FIG. 26.

FIGS. 26 and 27 depict exemplary reflector clip assembly (700). Reflector clip assembly (700) is configured similarly to reflector clip assembly (600) except with an elongated clip member (702) having extended height compared to reflector clip assembly (600). Elongated clip member (702) provides an area for attaching reflector target assembly (604). Attachment of reflector target assembly (604) is similar to that described above with attachment of reflector target assembly (604) to clip member (602) of reflector clip assembly (600). In the present example, clip member's (702) elongated configuration allows reflector target assembly (604) to be mounted at a higher position where sensor (506) can see or detect reflector target (630) of reflector target assembly (604) when elevator car (30) is located at landing (50) of the first floor level. In some arrangements, where sensor (506) is mounted to a portion of door operator assembly (108) as shown in FIG. 21, and with a clip member mounted to hoistway header (102), if clip member (602) is used at landing (50) at the first floor level, then sensor (506) can be positioned above an attached reflector target assembly (604) where sensor (506) cannot see or detect reflector target (630) of reflector target assembly (604). This same result does not occur at the other floors where the elevator car (30) travels up or down past reflector clip assembly (600), even though when elevator car (30) is positioned at a given landing (50), sensor (506) is located above the nearest reflector clip assembly (600). It is only at the bottom floor where sensor (506), with its described mounting location and arrangement, would sit above reflector clip assembly (600) and effectively never be in a position across from reflector clip assembly (600) to detect reflector target (630) connected thereto. Note that the description of "first floor" above, in this sense, is intended to signify the bottom floor of a particular elevator arrangement. The use of elongated clip member (702) at the bottom floor compensates for the above-described phenomenon. Thus for hoistway header (102) at landing (50) of the first floor level (bottom floor level), elongated clip member (702) can be used instead of clip member (602). It is further understood that the combination of elongated clip member (702) with reflector target assembly (604) comprises exemplary reflector clip assembly (700) as shown in FIG. 26.

Clip member (702) also comprises plate (706), arms (708), alignment targets (712), hole (716), and vertical slots (713). Arms (708) are comparable to arms (608) of clip member (602) and the description of arms (608) above applies equally to arms (708). Vertical slots (713) are comparable to vertical slots (613) of clip member (602) and the description of vertical slots (613) above applies equally to vertical slots (713). Alignment targets (712) are comparable to alignment targets (612) of clip member (602) and the description of alignment targets (612) applies equally to alignment targets (712). Finally hole (716) is comparable to hole (616) of clip member (602) and the description of hole (616) applies equally to hole (716).

Exemplary Operation of Elevator Positioning System with Reflector Target

When elevator positioning system (500) is arranged as described above, reflector clip assemblies (600) are mounted in hoistway (10) at hoistway headers (102) of each floor level along the travel path of elevator car (30), with reflector clip assembly (700) being used at landing (50) of first floor level. Reflector clip assemblies (600, 700) are thus at discrete locations or positions within the hoistway (102) and thus do not continuously extend within hoistway (102). Sensor (506) is positioned on or near elevator car (30) such that it travels with elevator car (30) and can sense or detect reflector targets (630) of reflector clip assemblies (600, 700) as sensor (506) moves with elevator car (30) between landings (50). When elevator car (30) is moving between landings (50), sensor (506) transmits a beam of light and when sensor (506) passes by reflector targets (630), sensor receives reflected light and thereby senses or detects reflector clip assemblies (600, 700) as the case may be. At this point, sensor (506) provides a signal to elevator controller (501) based on the detection of a reflector target (630). The precise known placement of reflector clip assemblies (600, 700) within hoistway (10) and the known location of landings (50) can be inputs to elevator controller (501) such that the detected reflector targets (630) allow for elevator controller (501) to control elevator car (30) to stop at a programmed count either below or above the point the reflector targets (630) are detected by sensor (506). The programmed count can be, for example, a distance measurement. This then allows for elevator car (30) to be stopped in alignment with landing (50) such that the floor of elevator car (30) exactly or substantially aligns with the floor of landings (50).

Elevator positioning system (500) is capable of calculating, accounting for, and/or compensating for building compression phenomenon that can occur in multi-story buildings. In such instances where building compression has occurred after the installation of elevator positioning system (500), even with such compression, elevator positioning system (500) is still able to align elevator car (30) with landings (50). By way of example and not limitation, after building (20) has been constructed, building (20) may undergo a compression due to settling and other factors apparent to those of ordinary skill in the art in view of the teachings herein. In the above example, hoistway headers (102) are associated with landings (50), and hoistway headers (102) are connected between entrance struts (104) in hoistway (10). Struts (104) are connected to the front wall of hoistway (10) and thus undergo a similar amount of compression as building (20) and its landings (50) experience. Likewise, hoistway headers (102) are impacted by the compression similarly as hoistway headers (102) are connected with struts (104). As time progresses and building compression occurs, the position of landings (50) relative to nearby hoistway headers (102) installed between struts (104) is largely unchanged. At the same time the relative distance between one hoistway header (102) and the next hoistway header (102) (or one landing (50) and the next landing (50)) may have changed due to building compression. Because, in the present example, positioning elevator car (30) can be based on measuring the relative movement from one landing (50) to another landing (50) after compression by detecting interruptions associated with reflector clip assemblies (600, 700) installed at hoistway headers (102), the system can continue to properly position and align elevator car (30) with landings (50) even though building compression may have occurred.

With respect to measuring and compensating for building compression, sensor (506) can be used to detect relative changes in the distances between the various mounted reflector clip assemblies (600, 700) in the system, e.g., measuring the distance between an reflector clip assembly (600) on one hoistway header (102) compared to another reflector clip assembly (600) on another hoistway header (102). This data can be captured at some desired frequency and processed to evaluate building compression over time and how various regions of building (20) may be affected differently by building compression. In other words, differences in measurements over time between reflector clip assemblies (600, 700) on hoistway headers (102) provides information indicating the location and amount of compression a building has experienced. Furthermore, elevator controller (501) can be updated as needed based on the compression data gathered over time to keep elevator positioning system (500) operating properly to align elevator car (30) with landings (50). Such updates to elevator controller (501) can include updating or adjusting a programmed count either below or above a detected reflector clip assembly (600, 700) at a hoistway header (102) for stopping elevator car (30).

When arranging reflector clip assemblies (600) on mounting brackets (116) (or mounting brackets (416) as described further below), it is possible to orient reflector clip assemblies (600) in a right-side-up configuration as shown in the illustrated version, or reflector clip assemblies (600) could be rotated 180 degrees to be mounted in an upside-down orientation. These multiple orientations provide a range of adjustability. The same right-side up and upside-down connection arrangements are possible with optical tape clips (200, 300) as described above.

Exemplary Alternative Mounting Arrangement with Reflector Target

Figure 28:
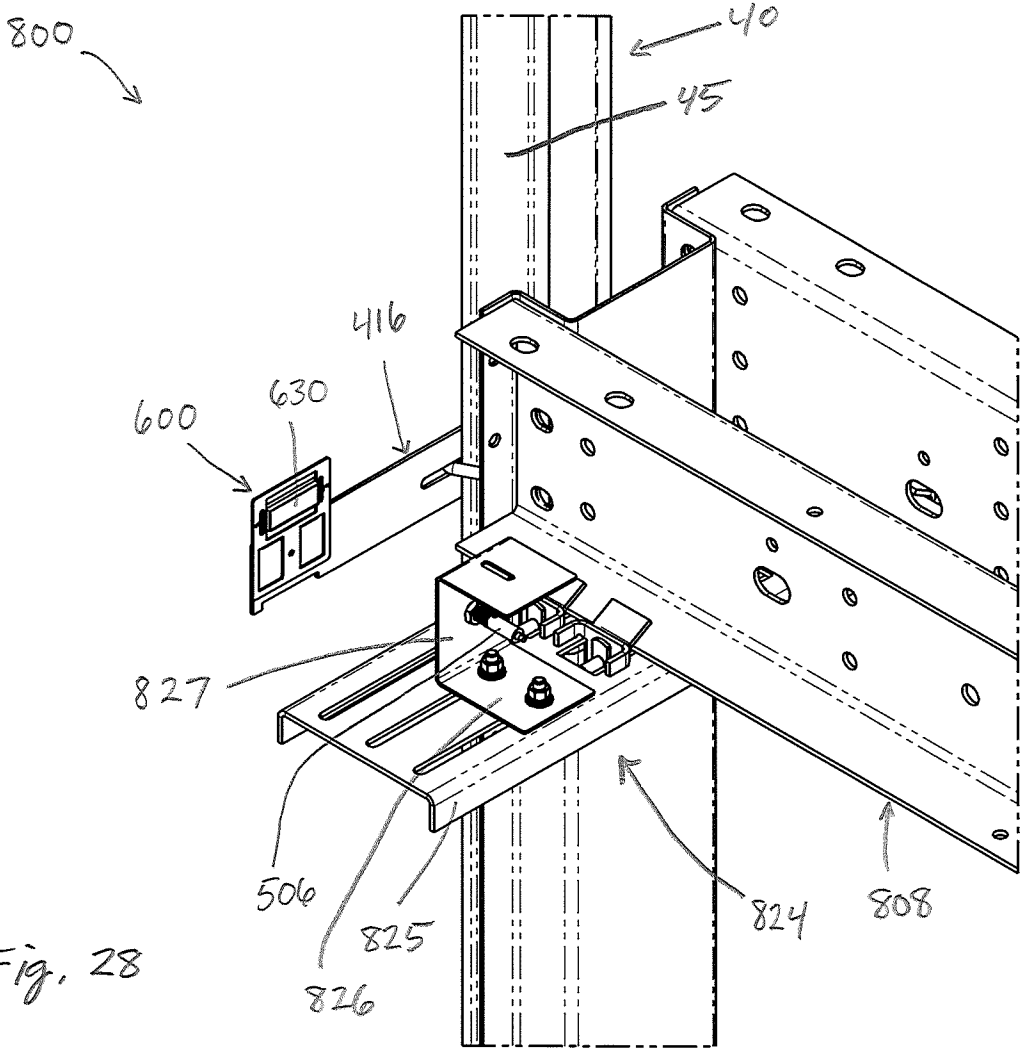
FIG. 28 depicts a partial perspective view of an exemplary hoistway showing another reflector clip assembly mounting configuration.

The mounting arrangement described above with reflector targets (630) can be used for new elevator installations in some versions. In some other versions an alternate mounting arrangement can be used, e.g., for a modernization installation where an elevator positioning system as described here is installed into an existing elevator system. FIG. 28 illustrates an exemplary alternative mounting arrangement for elevator positioning system (800), similar to elevator positioning system (500) described above, using reflector clip assemblies (600) and sensor (506) but mounted in this version in an orientation that is generally perpendicular to the orientation described above with reference to FIGS. 21 and 22. In the illustrated versions here as before, elevator positioning system (800) is used with elevator car (30) disposed in hoistway (10). In this alternate arrangement, reflector clip assemblies (600) are mounted to mounting brackets (416) attached to rails (40) but in a fashion where mounting brackets (416) and reflector clip assemblies (600) extend generally perpendicular to the openings for accessing landings (50). In this configuration, mounting brackets (416) with attached reflector clip assemblies (600) would be positioned at a location even with every hoistway header.

Sensor (506) is attached to crosshead (808) via crosshead bracket assembly (824) that comprises first portion (825), second portion (826), and third portion (827). Crosshead (808) extends between rails (40) and crosshead bracket (824) extends generally perpendicular to rails (40). In this alternate mounting arrangement, reflector targets (630) of reflector clip assemblies (600) face the direction of sensor (506), which is configured to sense reflector targets (630), in a manner similar to that described above for elevator positioning system (500).

Rails (40) comprise first rail portions (45) to which mounting brackets (416) are configured to attach. In the present example, mounting brackets (416) attached to rails (40) at first rail portions (45) using a clamp mechanism (417) as shown in FIG. 19. Still other ways to attach mounting brackets (416) to rails (40) will be apparent to those of ordinary skill in the art in view of the teachings herein. Reflector clip assemblies (600) are configured to attach to mounting brackets (416) in the same or similar fashion as described above with respect to hoistway headers (102) or mounting brackets (116).

In the alternate mounting arrangement described here, in some versions at the first floor level, mounting bracket (416) attaches to rail (40) at a position even with hoistway header (102) at the first floor level. In such a case, elongated reflector clip assembly (700) would be used at the first floor level such that sensor (506) and reflector clip assembly (700) will be relatively positioned so that sensor (506) can see or detect reflector target (630) of reflector clip assembly (700). This setup is largely for the same reasons as discussed above with respect to the other arrangement discussed. Still yet, in other versions using the alternate mounting configuration, it is possible to adjust the placement of mounting bracket (416) at the first floor level such that a standard sized reflector clip assembly (600) can be used even at the first floor level. In such a case, at the first floor level, mounting bracket (416) would be attached to rail (40) above hoistway header (102) at the first floor level. In this approach, the location of mounting bracket (416) at the first floor is used as the adjustment to ensure that sensor (506) is located relative to reflector clip assembly (600) at the first floor level such that sensor (506) is able to see and detect reflector target (630) of reflector clip assembly (600).

When installed in this illustrated alternate mounting arrangement, reflector clip assembly (600) faces toward a side of elevator car (30). Elevator car (30) includes elevator crosshead (808) to which sensor (506) is attached as mentioned above. First portion (825) of crosshead bracket assembly (824) is configured to attach to crosshead (808) transversely projecting from crosshead (808) via fasteners such as screws, bolts, clamps, and the like. Second portion (826) of crosshead bracket assembly (824) connects with first portion (825) via one or more bolts that extend through apertures. Third portion (827) of crosshead bracket assembly (824) connects with second portion (826) and upwardly projects from first and second portions (825, 826). Sensor (506) is configured to attach to third portion (827) or crosshead bracket assembly (824) such that a front, transmitting and receiving portion of sensor (506) faces toward positioned reflector clip assembly (600), as shown in FIG. 28.

Elevator positioning system (800) operates in a manner similar to elevator positioning system (500) described above. In the present example of elevator positioning system (800), reflector clip assemblies (600, 700) are mounted to rails (40) via mounting brackets (416). Mounting brackets (416) are positioned such that reflector clip assemblies (600) are located at every floor landing such that the vertical distance between mounting brackets (416) is equal to the floor-to-floor height. Again, reflector clip assembly (700) may be used at the first floor level as discussed above. Sensor (506) moves with crosshead (808) which moves with elevator car (30) through hoistway (10). As sensor (506) travels it detects reflector targets (630) of reflector clip assemblies (600, 700) when passing by reflector clip assemblies (600, 700). This then signals elevator controller (501) as described further previously.

In versions described above, reflector clip assemblies (600, 700) comprises a dual component design where reflector target assembly (604) connects with clip member (602, 702) via a cut-out window (605, 705) or opening in clip member (602, 702) that provides space for attaching reflector target assembly (604). As discussed rivets (636) are used to connect reflector target assembly (604) with clip members (602, 702). Furthermore in the illustrated versions, each clip member (602, 702) are comprised of a single piece of cut and bent material. In other versions clip members (602, 702) may be made from more than one piece where such pieces are joined together and combined with reflector target assembly (604) to form reflector clip assemblies (600, 700). In view of the teachings herein, other ways to construct reflector clip assemblies (600, 700) will be apparent to those of ordinary skill in the art.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of any claims that may be presented and is understood not to be limited to the details of structure and operation shown and described in the specification and drawings.

I claim:

1. An elevator positioning system for aligning an elevator car with one or more landings, wherein the elevator car is operable to travel within a hoistway to the one or more landings, wherein the elevator positioning system comprises:

a. a sensor configured to attach to a portion of the elevator car;

b. a detectable member, wherein the detectable member is detectable by the sensor;

c. at least one positioning member, wherein the positioning member is attachable to a select one of a portion of the hoistway and an elevator guide rail, wherein the positioning member is positionable so that the sensor can detect a select one of the presence of the detectable member and the absence of the detectable member, and wherein the sensor signals the detection to an elevator controller of the elevator positioning system to control position of the elevator car within the hoistway relative to the one or more landings; and d. one or more alignment targets configured to provide the positioning system with fine vertical adjustment for the position of the elevator car relative to the one or more landings.

2. The system of claim 1, wherein the positioning member is attachable without the use of tools.

3. The system of claim 1, wherein the positioning member comprises one or more resilient arms that are configured to grasp the select one of the portion of the hoistway and the elevator guide rail.

4. The system of claim 1, wherein the positioning member comprises one or more guides that are configured to minimize lateral movement of the detectable member while permitting vertical movement of the detectable member.

5. The system of claim 1, wherein the one or more alignment targets comprise a center target, a lower target, and an upper target, wherein alignment targets are vertically spaced.

6. The system of claim 5, wherein the center target, the lower target, and the upper target are spaced apart by about 0.375 inches.

7. The system of claim 1, wherein the positioning member comprises a primary clip and a secondary clip, wherein the secondary clip is configured to attach with the primary clip, wherein the primary clip is configured to attach with the select one of the portion of the hoistway and the elevator guide rail.

8. The system of claim 7, wherein the secondary clip comprises one or more resilient arms configured to grasp the primary clip.

9. The system of claim 7, wherein the secondary clip comprises a portion configured to extend across the primary clip without contacting the primary clip.

10. The system of claim 9, wherein the portion of the secondary clip is configured to obstruct the sensor's view of the detectable member.

11. The system of claim 1, wherein the positioning member comprises an opening, wherein the detectable member is positioned within the opening.

12. The system of claim 1, wherein the positioning member comprises one or more vertical slots generally adjacent to the one or more alignment targets.

13. The system of claim 1, wherein the detectable member is positioned on the positioning member, wherein detectable member is adjustable relative to the one or more alignment targets.

14. The system of claim 12, wherein the detectable member adjustably attaches with the one or more vertical slots.

15. The system of claim 1, wherein the positioning member located at the bottom floor comprises an extended height compared to the positioning members located at the other floors.

16. The system of claim 15, wherein the sensor is positioned above the positioning member at each floor landing above the bottom floor.

17. The system of claim 1, wherein the detectable member continuously extends the length of travel of the elevator car within the hoistway.

18. The system of claim 1, wherein the detectable member is positioned at discrete locations within the hoistway and does not extend continuously within the hoistway.

19. The system of claim 1, wherein the positioning member is constructed from one or more stamped metal pieces.

20. The system of claim 19, wherein the positioning member is constructed from two stamped metal pieces that are configured to attach together without the use of tools.

21. A method for positioning and aligning an elevator car with a landing, wherein the method comprises:

a. attaching a sensor to the elevator car;

b. attaching at least one positioning member to a select one of a portion of a hoistway and an elevator guide rail, wherein the at least one positioning member attaches without the use of tools, wherein the positioning member is associated with a detectable member, wherein the at least one positioning member comprises one or more alignment targets;

c. moving the elevator car such that the sensor travels past the at least one positioning member and the detectable member;

d. detecting a select one of the presence of the detectable member and the absence of the detectable member;

e. signaling the detection to an elevator controller to control position of the elevator car within the hoistway relative to the landing; and f. adjusting a portion of the at least one positioning member relative to the one or more alignment targets to provide fine vertical adjustment of the elevator car relative to the landing.

22. A detection member for use with a sensor in an elevator hoistway in which an elevator car travels to one or more landings, the detection member comprising:

a. a clip configured to attach to a select one of a portion of a hoistway and an elevator guide rail using one or more resiliently biased arms configured for grasping;

b. a detectable portion; and c. one or more alignment targets configured to provide a reference for setup and adjustment of a vertical position of the detectable portion relative to the clip to provide fine vertical adjustment of the elevator car relative to the one or more landings.

23. The detection member of claim 22, wherein the detectable portion is configured to be detected as a select one of the detected presence of the detectable portion and the detected interruption caused by the detectable portion.

* * * * *